US008376873B2

(12) United States Patent
Golden et al.

(10) Patent No.: US 8,376,873 B2
(45) Date of Patent: Feb. 19, 2013

(54) GOLF CLUB HEAD WITH REPLACEABLE FACE

(75) Inventors: Charles E. Golden, Carlsbad, CA (US); John Morin, Carlsbad, CA (US); Helene Rick, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 527 days.

(21) Appl. No.: 12/616,218

(22) Filed: Nov. 11, 2009

(65) Prior Publication Data

US 2011/0111885 A1 May 12, 2011

(51) Int. Cl.
*A63B 53/04* (2006.01)
*A63B 53/06* (2006.01)

(52) U.S. Cl. ..... 473/244; 473/342

(58) Field of Classification Search ..... 473/324–350, 473/244–248

See application file for complete search history.

(56) References Cited

U.S. PATENT DOCUMENTS

| | | | | | |
|---|---|---|---|---|---|
| 1,665,523 | A * | 4/1928 | Boyce | 473/245 |
| 2,026,749 | A * | 1/1936 | Pester | 473/245 |
| 2,175,598 | A * | 10/1939 | Fedak | 473/245 |
| 2,201,638 | A * | 5/1940 | Theibault, Sr. | 473/245 |
| 3,190,651 | A * | 6/1965 | Thomas | 473/245 |
| 4,150,464 | A | 4/1979 | Tracy | |
| 4,618,149 | A * | 10/1986 | Maxel | 473/245 |
| 5,141,231 | A * | 8/1992 | Cox | 473/330 |
| 5,505,453 | A * | 4/1996 | Mack | 473/329 |
| 5,509,660 | A * | 4/1996 | Elmer | 473/288 |
| 5,720,673 | A * | 2/1998 | Anderson | 473/342 |
| 6,102,813 | A * | 8/2000 | Dill | 473/305 |
| 6,348,011 | B1 | 2/2002 | Reyes et al. | |
| 6,402,637 | B1 * | 6/2002 | Sasamoto et al. | 473/324 |
| 6,428,426 | B1 * | 8/2002 | Helmstetter et al. | 473/330 |
| 6,527,648 | B2 * | 3/2003 | Erickson et al. | 473/221 |
| 6,533,681 | B2 * | 3/2003 | Inoue et al. | 473/342 |
| 6,558,272 | B2 * | 5/2003 | Helmstetter et al. | 473/329 |
| 6,595,057 | B2 | 7/2003 | Bissonnette et al. | |
| 6,602,150 | B1 * | 8/2003 | Kosmatka | 473/342 |
| 6,605,007 | B1 | 8/2003 | Bissonnette et al. | |
| 6,669,576 | B1 * | 12/2003 | Rice | 473/305 |
| 6,739,983 | B2 * | 5/2004 | Helmstetter et al. | 473/342 |
| 6,863,620 | B2 * | 3/2005 | Tucker, Sr. | 473/288 |
| 6,926,619 | B2 * | 8/2005 | Helmstetter et al. | 473/345 |
| 6,949,032 | B2 * | 9/2005 | Kosmatka | 473/342 |
| 6,964,617 | B2 * | 11/2005 | Williams | 473/245 |
| 7,115,047 | B2 * | 10/2006 | Stevens et al. | 473/334 |
| 7,160,205 | B2 | 1/2007 | Yamamoto | |
| 7,192,364 | B2 * | 3/2007 | Long | 473/329 |

(Continued)

FOREIGN PATENT DOCUMENTS

| | | | |
|---|---|---|---|
| GB | 2455109 A | * | 6/2009 |
| JP | 11076472 A | * | 3/1999 |

(Continued)

*Primary Examiner* — Alvin Hunter
(74) *Attorney, Agent, or Firm* — Randy K. Chang

(57) ABSTRACT

A golf club head having a replaceable striking face is disclosed herein. More specifically, the present invention discloses a golf club head where at least a portion of the frontal striking surface of the face is detachable and replaceable to improve performance. A golf club head in accordance with the present invention may generally have a thinned striking face with a thickness of less than about 3.0 mm yielding a golf club head with a larger sweet spot that's greater than 6% of the frontal striking surface; defined as an area of the frontal striking surface having at least 99% of the maximum characteristic time between about 239 microseconds to about 257 microseconds.

19 Claims, 23 Drawing Sheets

U.S. PATENT DOCUMENTS

| | | | | |
|---|---|---|---|---|
| 7,220,190 | B2 * | 5/2007 | Hirano | 473/342 |
| 7,335,112 | B1 * | 2/2008 | Bitondo | 473/238 |
| 7,338,390 | B2 * | 3/2008 | Lindsay | 473/345 |
| 7,361,100 | B1 | 4/2008 | Morales et al. | |
| 7,413,517 | B2 * | 8/2008 | Butler et al. | 473/288 |
| 7,559,853 | B2 * | 7/2009 | Hirano | 473/324 |
| 7,691,006 | B1 * | 4/2010 | Burke | 473/288 |
| 7,713,143 | B2 * | 5/2010 | Evans | 473/334 |
| 7,753,808 | B2 * | 7/2010 | Matsunaga | 473/342 |
| 7,935,003 | B2 * | 5/2011 | Matsunaga et al. | 473/342 |
| 8,033,931 | B2 * | 10/2011 | Wahl et al. | 473/342 |
| 8,062,151 | B2 * | 11/2011 | Boyd et al. | 473/334 |
| 2008/0146374 | A1 | 6/2008 | Beach et al. | |
| 2008/0242445 | A1 | 10/2008 | Mergy et al. | |
| 2008/0254911 | A1 | 10/2008 | Beach et al. | |
| 2009/0143167 | A1 * | 6/2009 | Evans | 473/335 |
| 2009/0270199 | A1 * | 10/2009 | Chen | 473/348 |

FOREIGN PATENT DOCUMENTS

| | | | |
|---|---|---|---|
| JP | 2004237039 | A * | 8/2004 |
| WO | WO 2008108509 | A1 * | 9/2008 |

* cited by examiner

GOLF CLUB HEAD WITH REPLACEABLE FACE

FIELD OF THE INVENTION

The present invention relates generally to a golf club head with a replaceable face. More specifically, the present invention relates to a driver type golf club head wherein at least a portion of the frontal striking face is detachable and replaceable to improve performance of the driver type golf club head. Even more specifically, the present invention relates to a driver type golf club head wherein the detachable and replaceable face may be thinner, resulting in a larger sweet spot.

BACKGROUND OF THE INVENTION

The game of golf has always been heavily related to the golf equipment used to play this game. Although the game of golf has deep roots keeping with the tradition of the game, golf club technology has come a long way to make the game of golf easier and more enjoyable for the average golfer.

The golf clubs of today have developed significantly to include numerous performance enhancing features such as creating an oversized hollow club head, creating a club with additional weights towards the bottom of the club to help promote launch, even including unconventional changes varying the shapes and geometries of a golf club head to square shapes and triangular shapes in order to improve performance of a golf club head. These types of technological advancement may be especially prevalent in a driver type golf club head, wherein we've seen drivers transition from a solid wooden persimmon golf club head to a hollow metallic golf club heads with volumes reaching close to 460 cubic centimeters; all for the purpose of improving performance of the driver type golf club head.

One of the main objectives of a driver type golf club is to hit a golf ball as far as possible while keeping the golf ball in a semi-straight flight path. Three major factors; namely launch angle, ball speed and spin rate, contribute to length of travel of a golf ball after it is struck by a golf club. Focusing on one of the most influential factors, ballspeed may generally be a function of the total kinetic energy imparted to the ball as it is being struck by a golf club deriving its potential energy from the golfer's golf swing. This kinetic energy within the golf club head may also be known as elastic strain energy and this energy may generally be related to the deformation of the golf club head as well as the golf ball. After impact, the kinetic energy generated by the golf club is transferred in the form of translational and rotational velocity on the ball causing the golf ball to fly off the face of the golf club head; correlating to what is commonly known as the ballspeed. However, because the collision between the golf club and the golf ball is not perfectly elastic, a portion of energy is lost and dissipated during the impact resulting in club head vibration as well as viscoelastic compression and relaxation of the ball.

In order to increase the ball speed coming off the striking surface of a golf club, it may generally be desirable to minimize energy lost between the golf ball and the golf club. One method of minimizing the energy lost between the golf ball and the golf club is to decrease the thickness of the face of the golf club; as decreasing the thickness of the face of the golf club head will cause the face of the golf club to deform like a trampoline, alleviating some of the viscoelastic compression and relaxation of the golf ball. Viscoelastic compression and relaxation of the golf ball, although difficult to observe using the naked eye, may generally be one of the major contributors to the amount of energy lost during impact. However, there is a limit as to how thin one can make the striking face of a golf club head, as a striking face that is made too thin may crack and break when subjected to the tremendous and continuous impacts between a golf club and a golf ball. Hence it can be seen that there is a diametrically opposing need to make the striking face of the golf club as thin as possible to maximize performance while at the same time making the striking face as thick as possible for durability.

The requirement for a golf club head striking face to be sufficiently thick and durable has been identified by U.S. Pat. No. 6,595,057 to Bissonnette et al. entitled Golf Club Head With a High Coefficient of Restitution when it states that a golf club head must be strong enough to withstand the impact forces that occur during collision between the head and the ball. The loading that occurs during this transient event can peak over 2,000 lbs and cause an acceleration of the golf ball that is four orders of magnitude than the acceleration of gravity. It is not unusual for club heads of hollow metal woods, produced from titanium, to have a uniform face thickness exceeding 0.15 inches.

U.S. Patent Publication No. 2008/0146374 to Beach et al. entitled Golf Club-Head Having a Particular Relationship of Face Area to Face mass also identifies this very important issue of durability and endurance by discussing how conventional ways of removing mass from the face plate are not always successful; if too much mass is removed from the face plate, the structural mass of the strike plate may be excessively compromised, which can result in the striking plate being too fragile and/or its COR being too high.

In fact, durability and endurance is such an important characteristic of a golf club, U.S. Pat. No. 6,348,011 to Reyes et al. entitled Texture Coating for Golf Club specifically address this issue by providing for a golf club having a texture coating exhibiting improved durability and aesthetic appearance on golf club head surfaces in order to improve the ability of a striking face of a golf club head to withstand the impact with a golf ball.

However, the limitations of durability and endurance are premised upon the conventional thinking that the striking surface of a golf club has to be sufficiently durable and strong so that it will not break or crack when striking a golf ball over a certain number of shots. Even more, golf clubs are often over-designed in a way so they will survive numerous strikes by an extremely strong hitter in order to ensure that the striking surface of the golf club will not break under any conceivable playing conditions, when the majority of the consuming public do not impart a fraction of the forces generated by an extremely strong hitter.

Alternatively, if a golf club is not constrained by such a conventional thought process, the striking face of the golf club could be designed in a way that it will be intended to fail, so long as the striking face is removable and maybe even disposable. This alternative approach to golf club design allows for improvement in the performance of the golf club by allowing the striking face to be manufactured much thinner with a larger sweet spot, so long as the striking face that eventually breaks may be removed and replaced. Sweet spot, as generally known in the golf industry, refers to the portion of the striking area that yields approximately the same ball speed when striking a golf ball. It can be seen from the above that there is a need in the field for golf club heads wherein the face of the golf club is removable and disposable allowing the striking face to be thinned to improve performance. More specifically, there is a need in the field for a golf club with a removable and disposable face allowing for face thicknesses of less than about 0.15 inches. Even more specifically, there is a need in the field for a golf club with removable and disposable face with a larger more uniform sweet spot that maintains 99% of the maximum ball speed for at least 6% of the entire frontal striking surface.

BRIEF SUMMARY OF THE INVENTION

One aspect of the present invention is a golf club head comprising of a body and a replaceable striking face. The body may comprise a crown portion and a sole portion. The replaceable striking face may comprise of an impact zone and a connection zone. The impact zone within the replaceable striking face may further contain a sweet spot that is defined as an area of the frontal striking surface of the golf club head having a characteristic time that is at least 99% of a maximum characteristic time of between about 239 microseconds to about 257 microseconds. The sweet spot within the impact zone may generally have an area that is greater than about 6% of the entire surface of the frontal striking surface; wherein the golf club impact zone may have a thickness of less than about 3.0 mm, and the golf club head has a volume of greater than about 350 cc.

In another aspect of the present invention is a golf club head comprising a body and a replaceable striking face releasably connected to the body. The body comprises a crown portion, a sole portion, and at least one screw well. The replaceable striking face comprises an impact zone, a connection zone, and at least one screw receptacle. The replaceable striking face here is connected to the body using at least one screw engaging at least one of the screw wells and at least one of the screw receptacles; wherein the thickness of the impact zone is less than about 3.0 mm, and the golf club head has a volume of greater than 350 cc.

In a further aspect of the present invention is a golf club head comprising a body and a replaceable striking face releasably connected to the body. The body comprises a crown portion, a sole portion, and at least one screw well. The replaceable striking face comprises a impact zone, a connection zone, and at least one screw receptacle. The replaceable striking face is connected to the body using at least one screw engaging at least one of the screw wells and at least one of the screw receptacles. The replaceable striking face further comprises a sweet spot defined as an area of a frontal striking surface of the golf club head having a characteristic time that is about 99% of a maximum characteristic time of between about 239 microseconds to about 257 microseconds; wherein the sweet spot comprises of greater than about 6% of the frontal striking surface, and wherein the golf club head has a primary first mode frequency of greater than about 3,500 Hertz.

These and other features, aspects, and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1A:
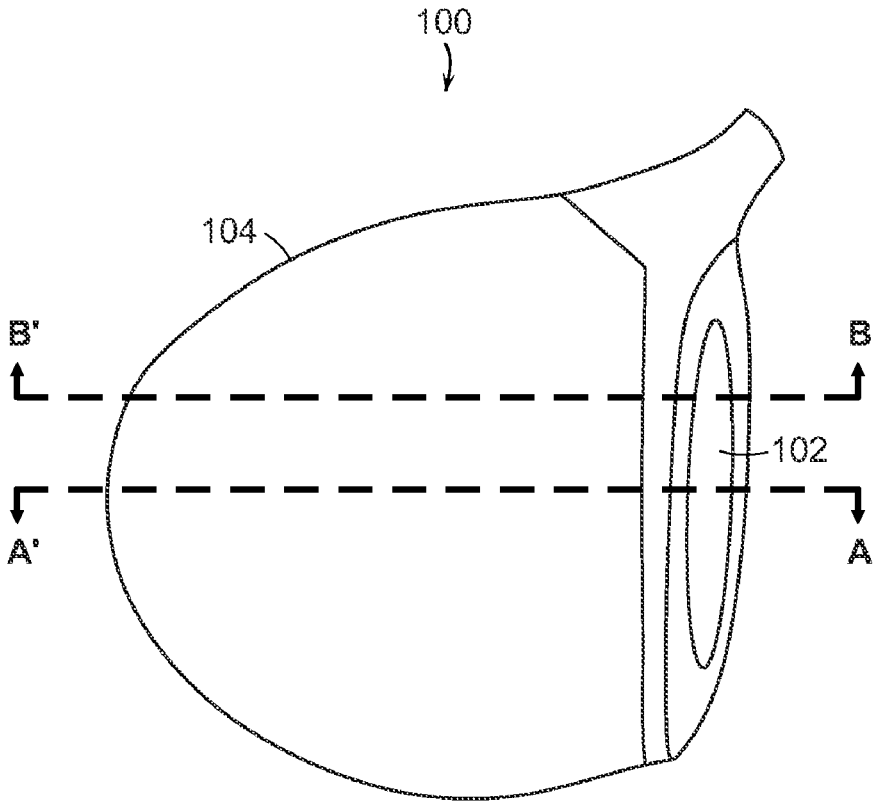
FIG. 1*a* shows a top view of a golf club head in accordance with an exemplary embodiment of the present invention.

FIG. 1*a* shows a top view of a golf club head 100 in accordance with an exemplary embodiment of the present invention. Golf club head 100, as shown here in the current exemplary embodiment, may generally be comprised of a replaceable striking face 102 as well as a body 104. FIG. 1*a* also shows a cross-sectional line A-A' across the length of the club taken along the middle of the golf club head in order to show the interface between the replaceable striking face 102 and the body 104. FIG. 1*a* also shows a cross-sectional line B-B' taken along the length of the club offset from the middle in order to show other attachment mechanisms.

Figure 1B:
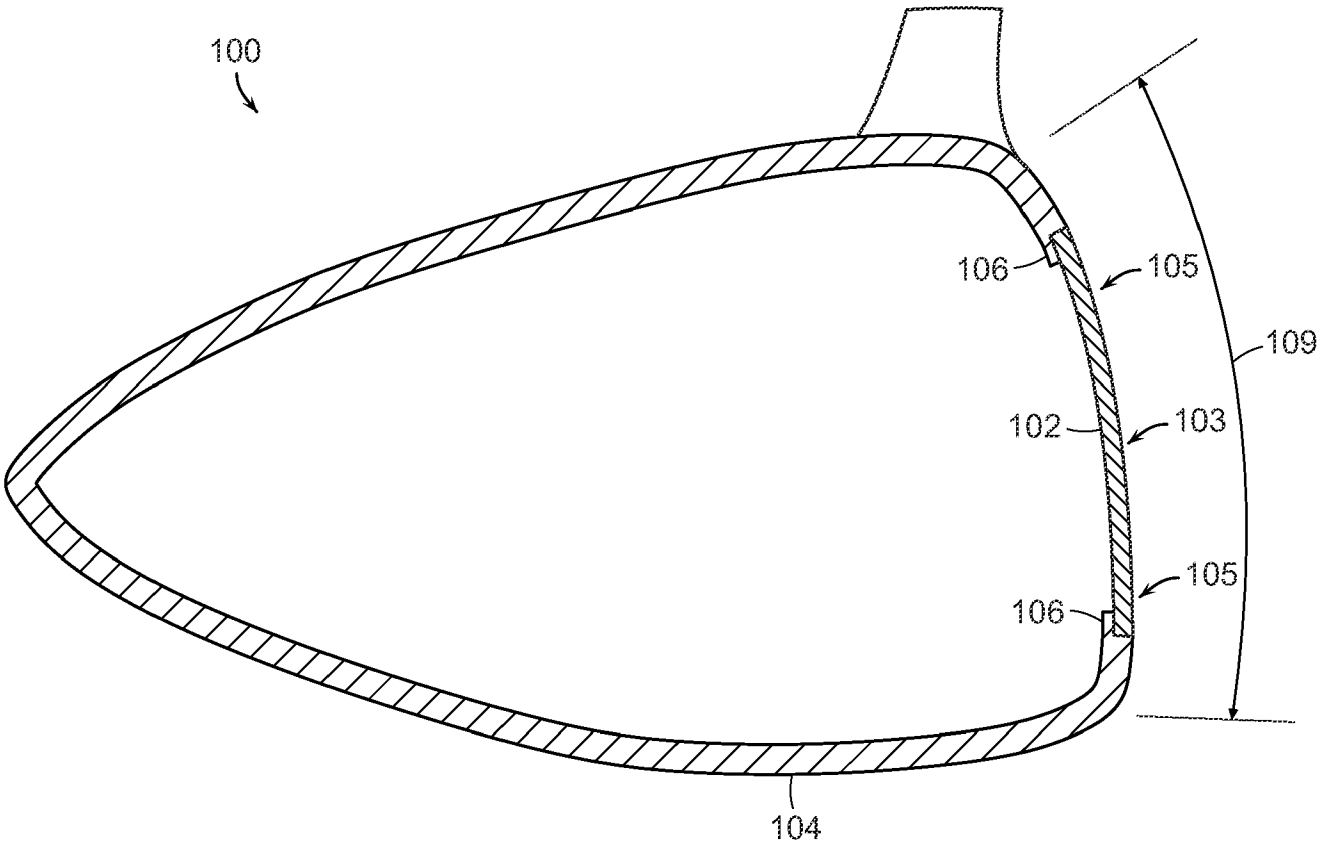
FIG. 1*b* shows a cross-sectional view of a golf club head in accordance with an exemplary embodiment of the present invention taken along cross-sectional line A-A' shown in FIG. 1*a;*

FIG. 1*b* shows a cross-sectional view of a golf club head 100 taken along cross-sectional line A-A' as shown in FIG. 1*a*. This cross-sectional view shown in FIG. 1*b* illustrates a replaceable striking face 102 that is significantly thinner than the body 104 of the golf club head 100 in accordance with the basic concept behind the current invention. Although FIG. 1*b* shows one embodiment of the present invention, numerous other embodiments may be used representing different connection mechanisms used to releasably connect the thinned replaceable striking face 102 to the body 104 of the golf club head. Thinned replaceable striking face 102, although generally made out of titanium for its material properties of being lightweight and durable, could also be comprised of other types of materials such as composite type material without departing from the scope and content of the present invention. Alternatively, the thinned replaceable striking face 102 could be multi-material that utilizes both titanium and composite material also without departing from the scope and content of the present invention. The thinned replaceable striking face 102, as shown in the current exemplary embodiment, may generally be less than about 3.0 mm thick, more preferably less than about 2.5 mm thick, and most preferably less than about 2.0 mm thick. This thinned replaceable striking face 102 shown in the current exemplary embodiment may generally be significantly thinner than the face thickness of a traditional prior art golf club head. Traditional golf club heads, in order to be sufficiently durable for the entire life of the golf club, may generally have a face thickness of no less than 2.5 mm.

The cross-sectional view of golf club head 100 shown in FIG. 1*b* may also help show the frontal striking surface 109 of the golf club head 100. The fontal surface 109 of a golf club head 100 in accordance with the present invention may generally refer to the entire surface area of golf club head 100 that could be used to strike a golf ball. To put it in another way, the frontal striking surface 109 may generally be defined as the surface of the golf club 100 that sits perpendicular to the ground while also being perpendicular to a golf ball at impact. Although golf club head 100 shown in FIG. 1*b* shows the frontal striking surface 109 to include the replaceable striking face 102 as well as parts of the body 104; the frontal striking surface 109 area could be entirely occupied by the replaceable striking face 102 without departing from the scope of the present invention.

In order to better define the different area of the replaceable striking face 102, FIG. 1*b* also shows an impact zone 103 as well as a connection zone 105. The impact zone 103 of the replaceable striking face 102 may generally be defined as the portion of the replaceable striking face 102 that may be used for striking a golf ball, while the connection zone 105 may generally be defined as the portion of the replaceable striking face 102 that may be used to connect with the body 104 of the golf club head 100. In this current exemplary embodiment shown in FIG. 1*b*, the impact zone 105 may comprise a plurality of backing tabs 106 extending from the body 104 may hold the replaceable striking face 102. Having a plurality of backing tabs 106 extending from the body 104 will allow the replaceable striking face 102 to be constructed independently of the remainder of the body 104, allowing it to be removable and replaceable at the discretion of the golfer.

Consequently, similar to numerous other commodities, there is no reason why a golf club can not become a product that sacrifices certain amount durability for increases in performance, so long as it offers a method to replace the component that is intended to fail. This thinned replaceable striking face 102 will redefine the traditional constraints of a golf club having to be durable enough for the entire lifetime of the golf club; thus allowing the use of a thinned replaceable striking face 102 capable of achieving a larger sweet spot. Having a bigger sweet spot in a golf club head 100 may generally be advantageous as it allows for golf shots that are hit off-center to be able to generate the same amount of ballspeed and distance as one that is struck at the exact center of the golf club face. This effect may generally be desirable to the average golfer who loses accuracy and distance when they do not hit a golf ball directly at the central sweet spot of a golf club.

Finally, golf club head 100 having a replaceable striking face 102, as shown in this current exemplary embodiment, may generally be applicable towards oversized driver type golf club heads. More specifically, a golf club head 100 in accordance with the present invention may generally have a volume of greater than 350 cubic centimeters (cc), more preferably greater than 370 cc, and most preferably greater than 390 cc. However, it should be noted that a golf club head 100 need not be a driver type golf club head, but could be a fairway type golf club head, a utility type golf club head, or even an iron type golf club head, all without departing from the scope and content of the present invention.

Figure 2:
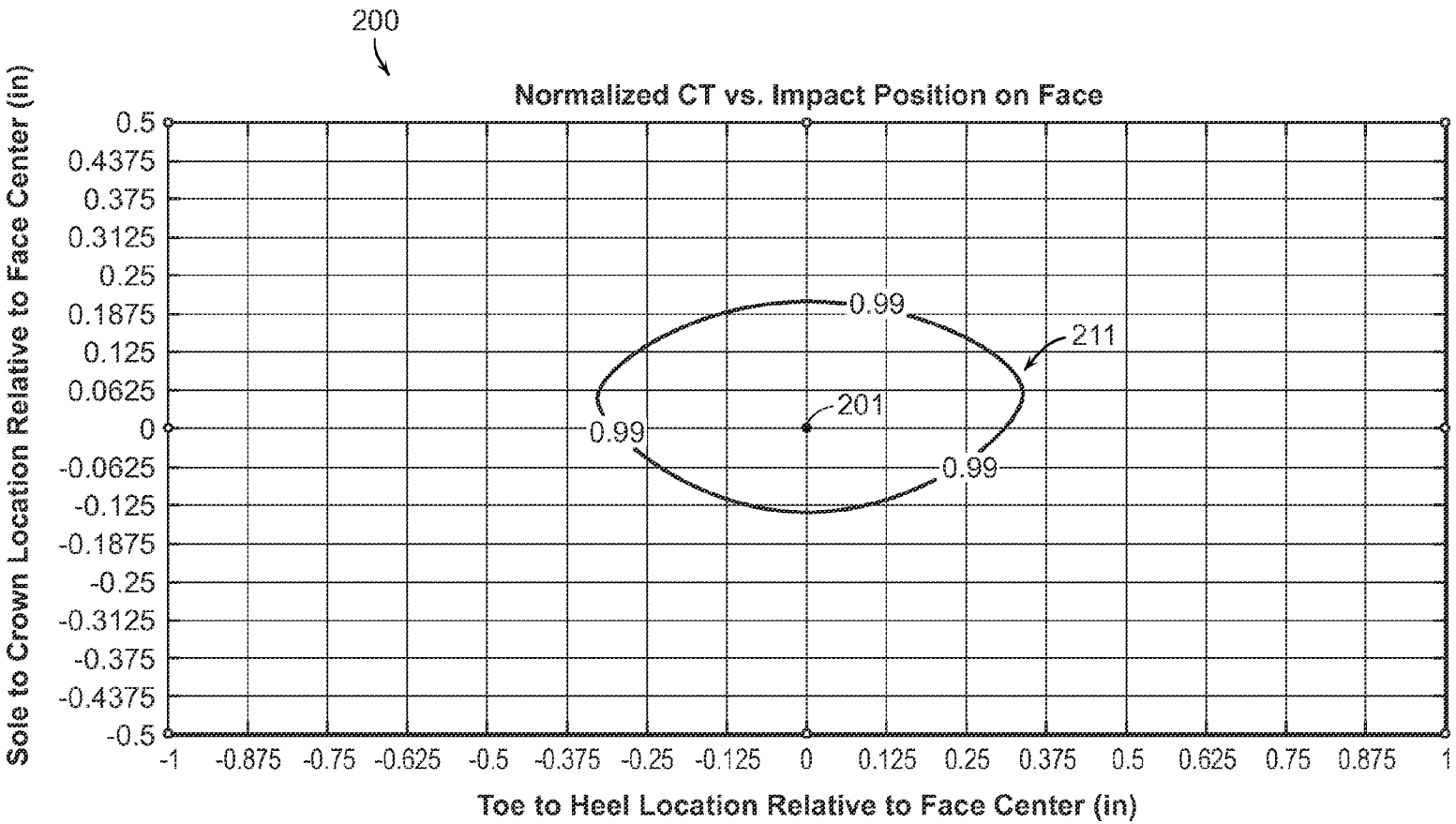
FIG. 2 (Prior Art)
FIG. 2 shows frontal view of prior art golf club head showing a partial characteristic time map taken on the frontal striking face.

FIG. 2 shows a close up view of the central region of a prior art frontal striking surface that is not disposable and can't be replaced while illustrating a simulated Characteristic Time (CT) map across the central portion face. The CT map shown in FIG. 2 focuses on a measurement zone 200 with a center point coinciding within the center 201 of the golf club face as determined with a standard United States Golf Association (USGA) template. This measurement zone may generally be defined as an area that is 2 inches wide horizontally and 1 inch in height vertically. As it can be seen from FIG. 2 the prior art striking face of a prior art golf club head may generally have a small sweet spot 211 that is defined as an area that is within 99% of the maximum characteristic time. More specifically, prior art golf club head may generally have about 4% of the frontal striking surface be within 99% of the maximum characteristic time that is measured at the center 201 of the frontal striking surface of the prior art golf club head. Maximum characteristic time, although may differ from club to club, may generally be constrained to the limits set forth by the USGA. More specifically, the maximum characteristic time that a golf club may achieve may generally be between about 200 microseconds to about 257 microseconds, more preferably between about 220 microseconds to about 257 microseconds, and most preferably between about 239 microseconds to about 257 microseconds. Here, shown in FIG. 2, we can see that the area of the face that is within 99% of the maximum characteristic time is about 110 $mm^2$, wherein the entire frontal striking surface area of a prior art golf club head is about 4200 $mm^2$, yielding only about 4% of the frontal striking surface having 99% of the maximum characteristic time.

Figure 3:
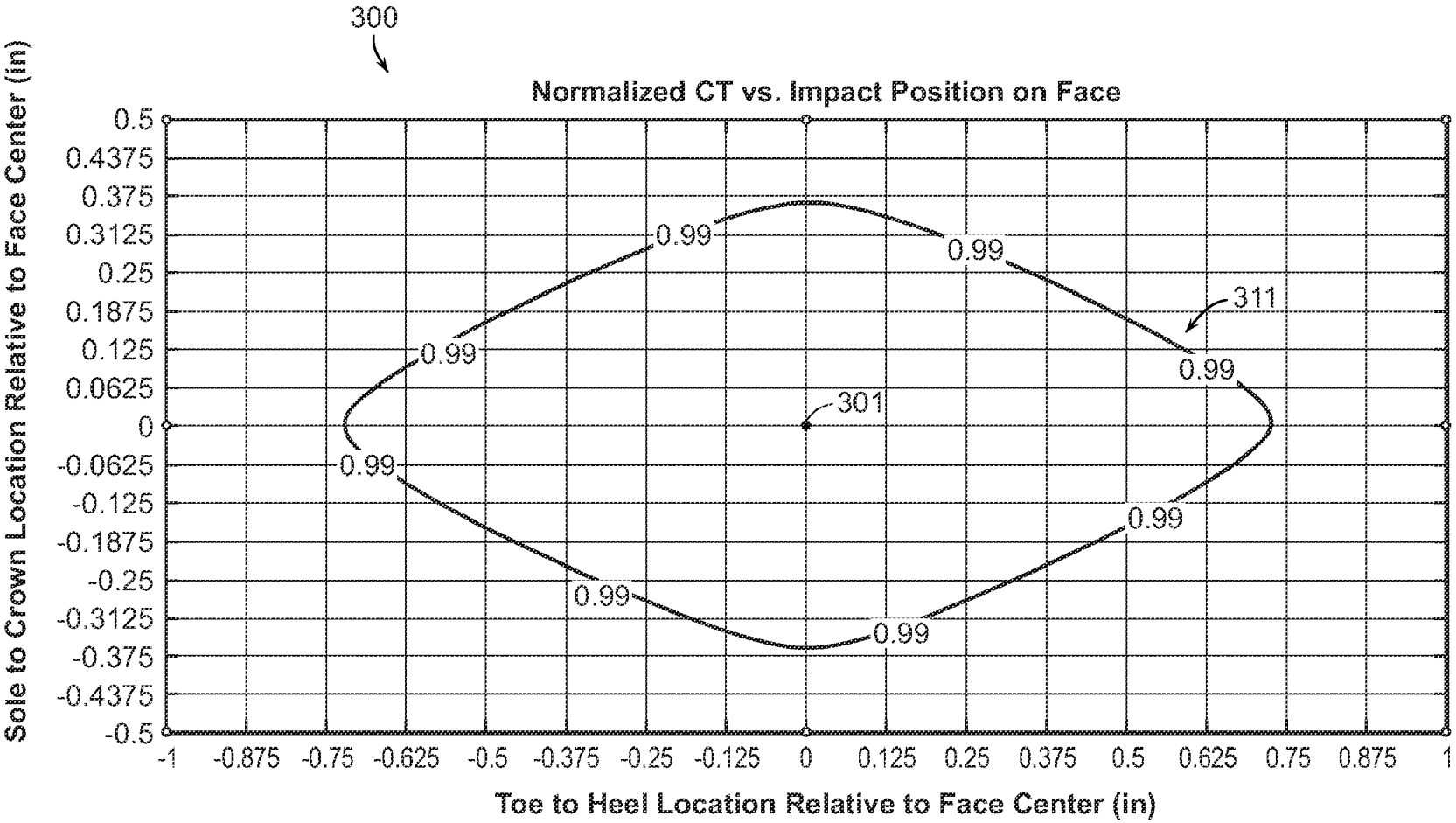
FIG. 3 shows a frontal view of a golf club head in accordance with an exemplary embodiment of the present invention showing a partial characteristic time map taken on the frontal striking face.

FIG. 3 shows a close up view of the frontal striking surface 109 (shown in FIG. 1*b*) of the current invention with simulated Characteristic Time (CT) results across the frontal striking surface 109 (shown in FIG. 1*b*). The CT map shown in FIG. 3 also focuses on a measurement zone 300 with a center point coinciding within the center 301 of the golf club head. This measurement zone may generally be defined as an area that is 2 inches wide horizontally and 1 inch in height vertically. As it can be seen from FIG. 3 the replaceable striking face 102 (shown in FIG. 1*b*) that is thinner than that of a traditional golf club is capable of achieving a significantly larger sweet spot 311 when compared to the prior art golf club head shown in FIG. 2. More specifically, the current replaceable striking face 102 may generally have greater than about 5% of the frontal striking surface 109 (shown in FIG. 1*b*) be within 99% of the maximum characteristic time measured at the center 301 of the frontal striking surface 109 (shown in FIG. 1*b*), more preferably greater than about 6%, and most preferably greater than about 7% of the entire frontal striking surface 109 (shown in FIG. 1*b*) area. Here, shown in FIG. 3, we can see that the area of the frontal striking surface 109 (shown in FIG. 1*b*) that is within 99% of the maximum characteristic time is about 200 $mm^2$, wherein the entire frontal striking surface 109 (shown in FIG. 1*b*) of the golf club head 100 generally remains constant at about 4200 $mm^2$, yielding the percentages above.

It should be noted that the replaceable striking face 102 (shown in FIG. 1*b*) may also have an increased surface area that is within 98% of the maximum CT measured at the center 301 of the frontal striking surface 109 (shown in FIG. 1*b*), as the contour plot of CT resembles a continuous gradient from the center outward. Similarly, replaceable striking face 102 (shown in FIG. 1*b*) may also have an increased surface area that is within 97% of the maximum CT, 96% of the maximum CT, 95% of the maximum CT, or any percentage of the maximum CT because of the continuous gradient of the CT plot all without departing from the scope and content of the present invention.

Characteristic time (CT), as discussed in the above FIGS. 2 and 3, are related to the pendulum test, which is the standard test for club face flexibility or trampoline effect under the USGA and international rules. In order to understand CT, it may be easier to relate CT to the concept of Coefficient of Restitution (COR) which is the ratio of the velocity of separation to the velocity of approach. More specifically, COR may be defined more accurately as Equation (1) below.

$$COR = \frac{v_{club-Post} - v_{ball-post}}{v_{ball-pre} - v_{club-pre}} \quad \text{Eq. (1)}$$

where, $v_{club-post}$ represent the velocity of the club after impact;

$v_{ball-post}$ represents the velocity of the ball after impact;

$v_{club-pre}$ represents the velocity of the club before impact (a value of zero for USGA COR conditions); and $v_{ball-pre}$ represents the velocity of the ball before impact.

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, a high COR value is indicative of greater ball velocity and distance.

COR may also be quantified as the flexural stiffness, which is measured as the inertance of the replaceable striking face 102. A further detailed discussion of the relationship between COR, flexural stiffness, and inertance may be found in U.S. Pat. No. 6,605,007 ('007 patent) to Bissonnette et al., and the disclosure of which is incorporated by reference herein in its entirety. The '007 patent also goes on to discuss a testing apparatus including a rigid mass, an accelerometer, and an impact hammer that is capable of measuring and quantifying the inertance of the replaceable striking face 102 in terms of a primary resonant face frequency of vibration for the club head. More detail discussion on the testing apparatus may also be found in the '007 patent, the disclosures of which is once again incorporated by reference in its entirety. Finally, because of the replaceable striking face 102 is thinner and disposable, the corresponding inertance number of a golf club head in accordance with the present invention may generally be less than about 3,000 Hertz, more preferably less than about 2,900 Hertz, and most preferably less than about 2850 Hertz, all without departing from the scope and content of the present invention.

Although we can see from above that CT is related to COR, CT is ultimately a measurement of the length of duration of contact between a golf club head and a pendulum at a specific spot on a golf club hitting face. This CT is measured in microseconds (μs), and generally correlates linearly with COR according to Equation (2) below.

$$CT=2257.9*(COR)-1617.3 \quad \text{Eq. (2)}$$

As can be seen from the above, the higher the COR, the longer the CT; and an increase in COR and CT numbers generally result from greater flexibility of the golf club hitting face.

Hence, we can see from the above, it may generally be desirable to design a golf club with the highest COR and CT numbers possible. Due to the inherent trampoline affect of the striking face of a golf club, the point of the highest COR and CT may generally be located in the vicinity of with the geometric center of the face, also known as the sweet spot; as the flexibility of the golf club head upon impact with a golf ball may help increase the COR and CT number. Having a high COR and CT number at the center of the face, although very desirable, may only be beneficial to the rare golfer who can consistently hit a golf ball at the center of the striking face of the golf club head. Hence, in order to make a golf club more user friendly to the average golfer who may not always hit a golf ball at the center of the golf club head; it may be desirable to design a golf club with a larger sweet spot.

As it may be already apparent in FIGS. 1*a* and 1*b*, designing a golf club with a bigger sweet spot may generally be possible by creating a golf club with a thinner face, allowing more of the striking area of the golf club to deflect, creating a larger sweet spot. However, because the striking face area of the golf club is subjected to tremendous stress during impact with a golf ball, a face that is too thin may crack or break from such repeated impact. Thus, until now, the design of a striking area of a golf club has been a constant struggle between the diametrically opposing goals of either making a striking area of a golf club that is as thin as possible to increase the size of the sweet spot or trying to make a golf club that is sufficiently thick enough to withstand the stresses associated with the impact between a golf club and a golf ball.

Traditional golf clubs have generally been designed favoring the durability aspect of the diametrically opposing forces mentioned above because traditional thinking within the golf industry has imposed an unnecessary constraint of having the golf club be sufficiently durable for the entire life of the golf club. This unnecessary constraint stems from the fact that the striking area being under the most stress is required to be permanently attached to the remainder of the golf club head. Thus, under this traditional constraint of golf club design, the entire golf club will become obsolete when the striking face, which is subjected to exponentially greater amount of stress compared to the remainder of the golf club, breaks due to the impact forces generated when striking a golf ball.

Hence, it can be seen that once a golf club designer frees him or herself from the unnecessary constraint of having the striking face area being fixedly attached to the remainder of the golf club, the golf club designer may create a golf club head 100 shown in FIG. 1*b* with a removable and replaceable striking face 102 to achieve a sweet spot area shown in FIG. 3 that was previously impossible to achieve based on traditional concept of golf club design.

Figure 4:
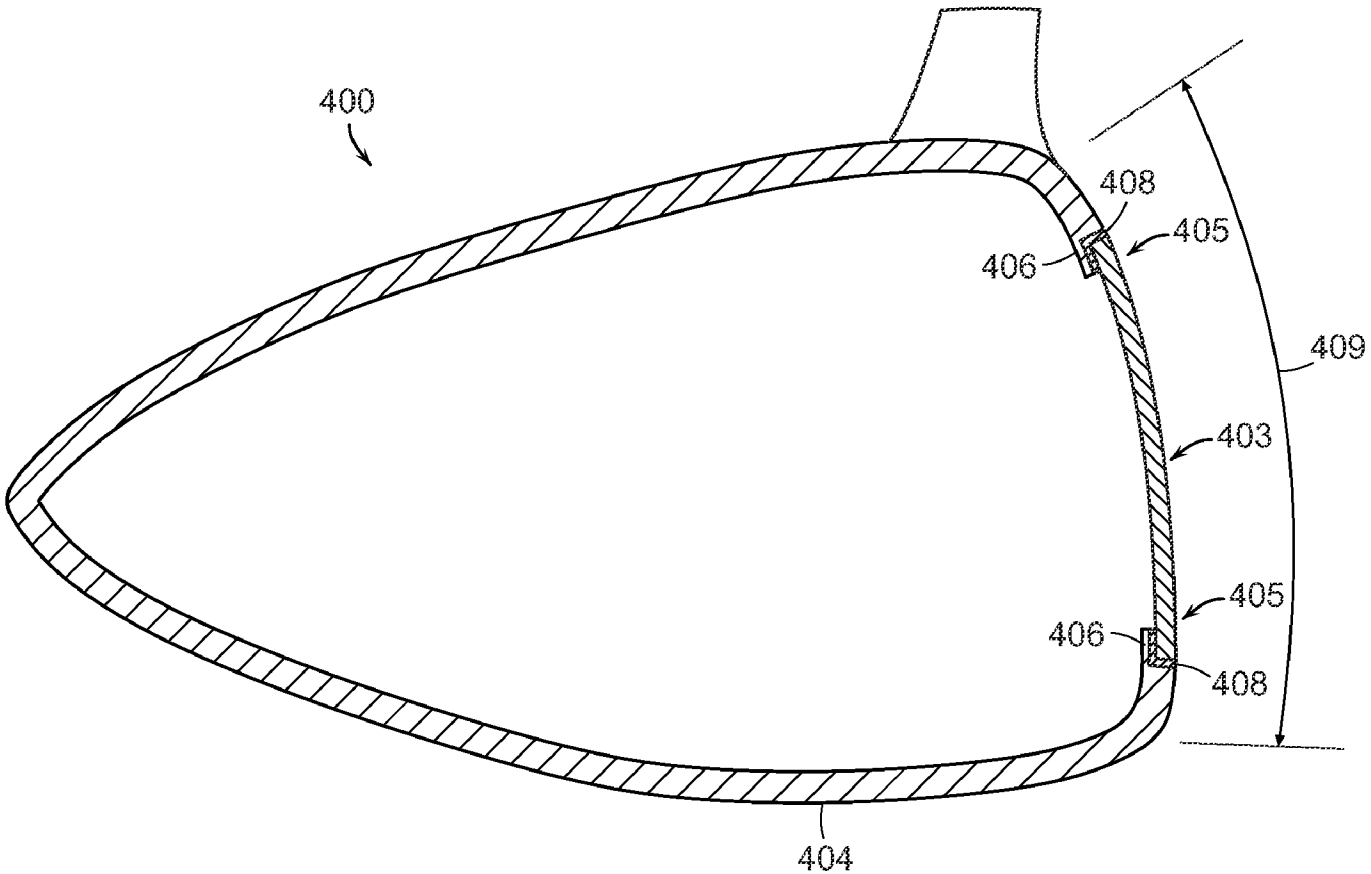
FIG. 4 shows a cross-sectional view of a golf club head in accordance with an exemplary embodiment of the present invention taken along cross-sectional line A-A' shown in FIG. 1*a;*

Turning now to FIG. 4 showing a cross-sectional view of a golf club head in accordance with an alternative embodiment of the present invention taken along cross-sectional line A-A' shown in FIG. 1*a*. It can be seen from the cross-sectional view shown in FIG. 4; golf club head 400 may have a replaceable striking face 402 wedged in between the plurality of backing tabs 406 within the body 404 of the golf club head 400. It should be noted that in this embodiment shown in FIG. 4, a vibration dampening material 408 may be placed in between the replaceable striking face 402 and the plurality of backing tabs 406 to eliminate any vibration between the replaceable striking face 402 and the body 404. Vibration dampening material 408, as shown in the current exemplary embodiment, may generally be an elastomer that could be either thermoset polymer or thermoplastic polymer such as rubber, polybutadiene, ethylene propylene rubber, silicone rubber, in any shape or size including but not limited to a torus shape, a rectangular shape, a circular shape, or any other shape so long as it is capable of reducing the amplitude of oscillation between the replaceable striking face 402 and the body 404 without departing from the scope and content of the present invention. Moreover, vibration dampening material 408 may also help seal the volume of the golf club head 400 in accordance with the USGA rules.

Figure 5:
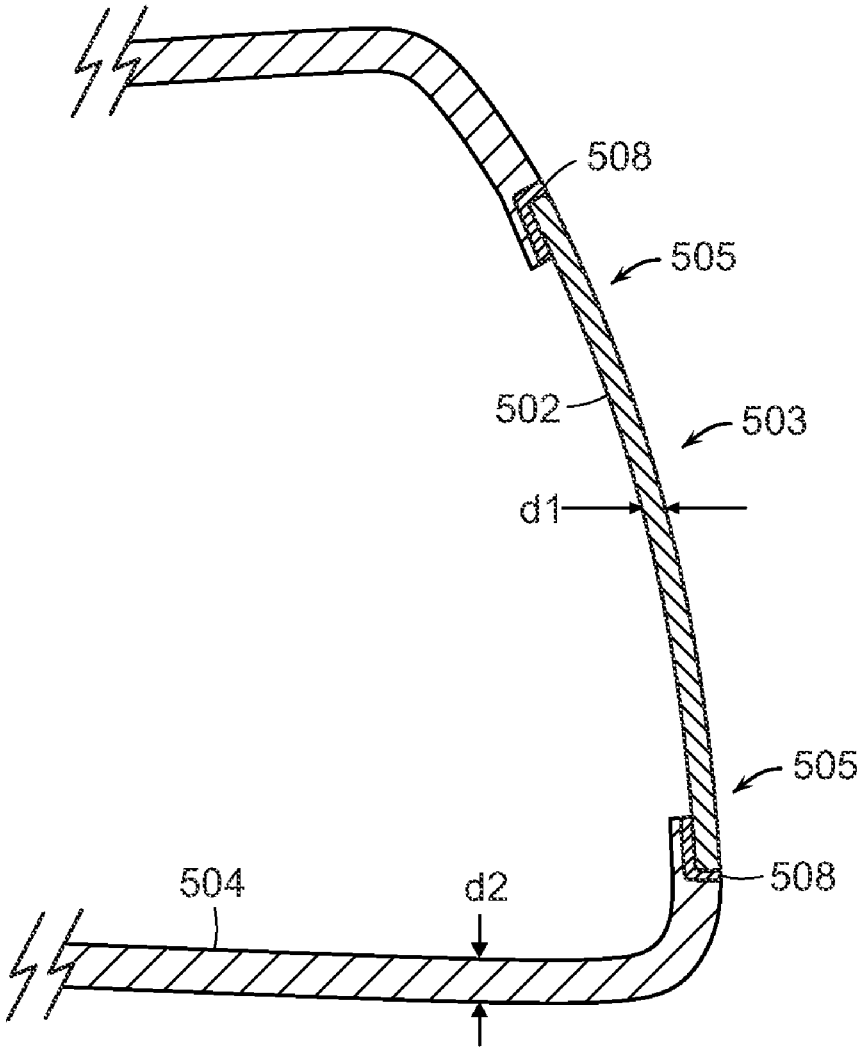
FIG. 5 shows an enlarged cross-sectional view of a golf club head shown in FIG. 4.

FIG. 5 shows a close up cross-sectional view of the alternative embodiment of the present invention previously shown in FIG. 4 wherein the thickness d1 of the replaceable striking face 502 can be more clearly shown. Thickness d1 of the replaceable striking face 502 in this current exemplary embodiment may generally be less than about 3.0 mm, more preferably less than about 2.5 mm, and most preferably less than about 2.0 mm in order to increase the size of the sweet spot area of the replaceable striking face 502 portion of the golf club head 500. In addition to the increase in sweet spot area, this reduction of thickness of the replaceable striking face region of the golf club head 500 may also reduce the overall weight of the golf club to create more discretionary weight that can be placed at other locations within the golf club head to improve performance. More specifically, this reduction in thickness of the replaceable striking face 502 may reduce the total mass of the replaceable striking face 502 compared to a traditional golf club without a thinned replaceable striking face by at least about 20 grams, more preferably by at least about 25 grams, and most preferably by at least about 30 grams.

In an alternative embodiment of the present invention, if the replaceable striking face 502 utilizes variable face thickness geometry, the thicknesses regions may be different based purely on the variable geometry. More specifically, in a variable face thickness replaceable striking face 502, the thickness of the thinnest region may be less than about 3.0 mm, more preferably less than about 2.5 mm, and most preferably less than about 2.0 mm. The thickness of the thickest region of a variable face thickness replaceable striking face 502 may be less than about 4.5 mm, more preferably less than about 4.0 mm, and most preferably less than about 3.5 mm.

It should also be noted that FIG. 5 also illustrates the thickness d2 of the body 504 of the golf club head 500 showing a relative comparison between the thickness d1 of the replaceable striking face 502 and the thickness d2 of the body 504. Thickness d2 of the body portion, as shown in the current exemplary embodiment, may also be as thin as 3.0 mm ensure the body 504 of the golf club head 500 be sufficiently durable to withstand an impact with a golf ball. Although the thickness d1 of the replaceable striking face 502 may generally be thinner than the thickness d2 of the body 504, the relative thickness' of d1 and d2 are not dependent upon one another and their individual thickness may be thinner or thicker than one another all without departing from the scope and content of the present invention.

Figure 6:
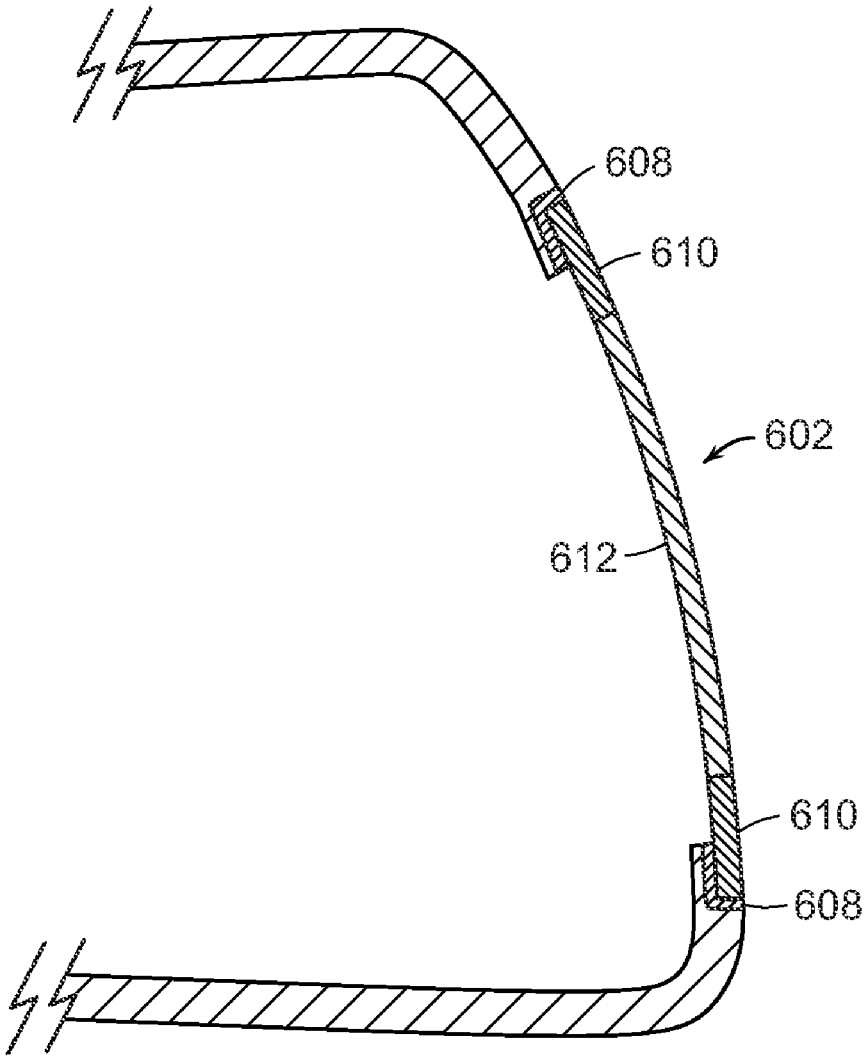
FIG. 6 shows an enlarged cross-sectional view of an alternative embodiment of a golf club head shown in FIG. 4.

Turning now to FIG. 6 showing a further alternative embodiment of the present invention wherein the replaceable striking face 602 may be further comprised of a perimeter portion 610 and a central portion 612. Replaceable striking face 602 may be comprised of two separate portions in order to further increase the size of the sweet spot and reduce the thickness of the striking face 602. Replaceable striking face 602 may achieve this by varying the modulus of elasticity of the perimeter portion 610 and the central portion 612. More specifically, the modulus of elasticity of the perimeter portion 610 may generally be lower than the modulus of elasticity of the central portion 612 to allow the entire central portion 612 to move as a unitary piece while concentrating the deformation at perimeter portion 610. In an exemplary embodiment, the perimeter portion 610 may be comprised of a thinned titanium material, a thinned composite material, a thinned plastic material, or any other material capable of achieving a relatively low modulus of elasticity without departing from the scope and content of the present invention. The central portion 612, having a higher modulus of elasticity, may generally be comprised of a titanium material, a steel material, an aluminum material, or any other material that is sufficiently rigid with a low modulus of elasticity.

Figure 7:
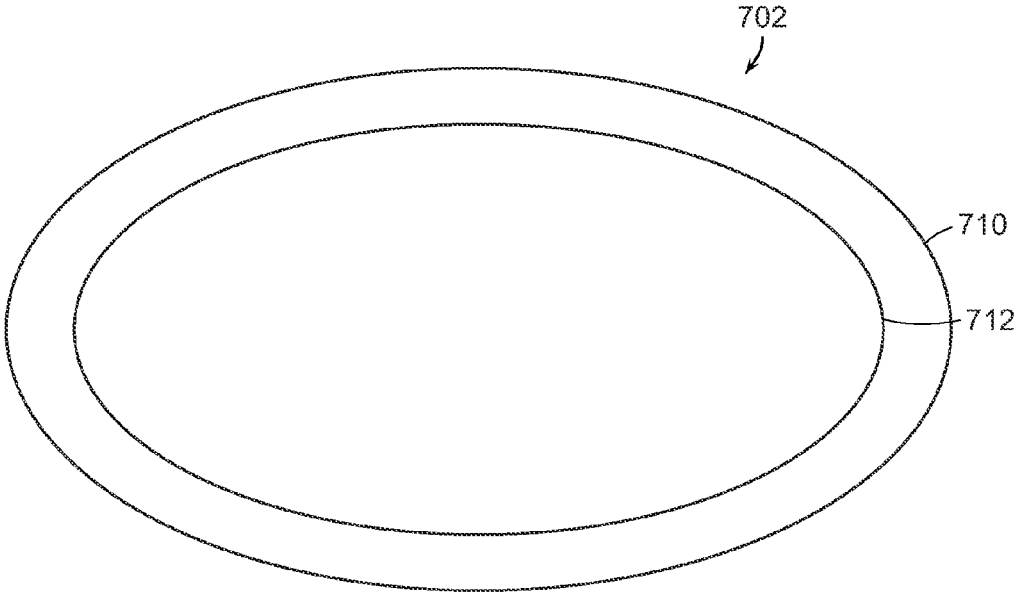
FIG. 7 shows a frontal view of a replaceable striking face in accordance with an alternative embodiment of the present invention.

The actual geometric shape of the perimeter portion 610 and the central portion 612 of the replaceable striking face 602 may be better illustrated in FIG. 7 showing a frontal view of the replaceable striking face 702. Here in FIG. 7 we can see that the perimeter portion 710 may generally encompass the central portion 712 allowing the outer region of the replaceable striking face 702 to be made out of a different material. However, in order to truly visualize the effect of the difference in modulus of elasticity between the perimeter portion 710 and the central portion 712, it may be desirable to view the dual portioned replaceable striking face 702 as it impacts a golf ball.

Figure 8:
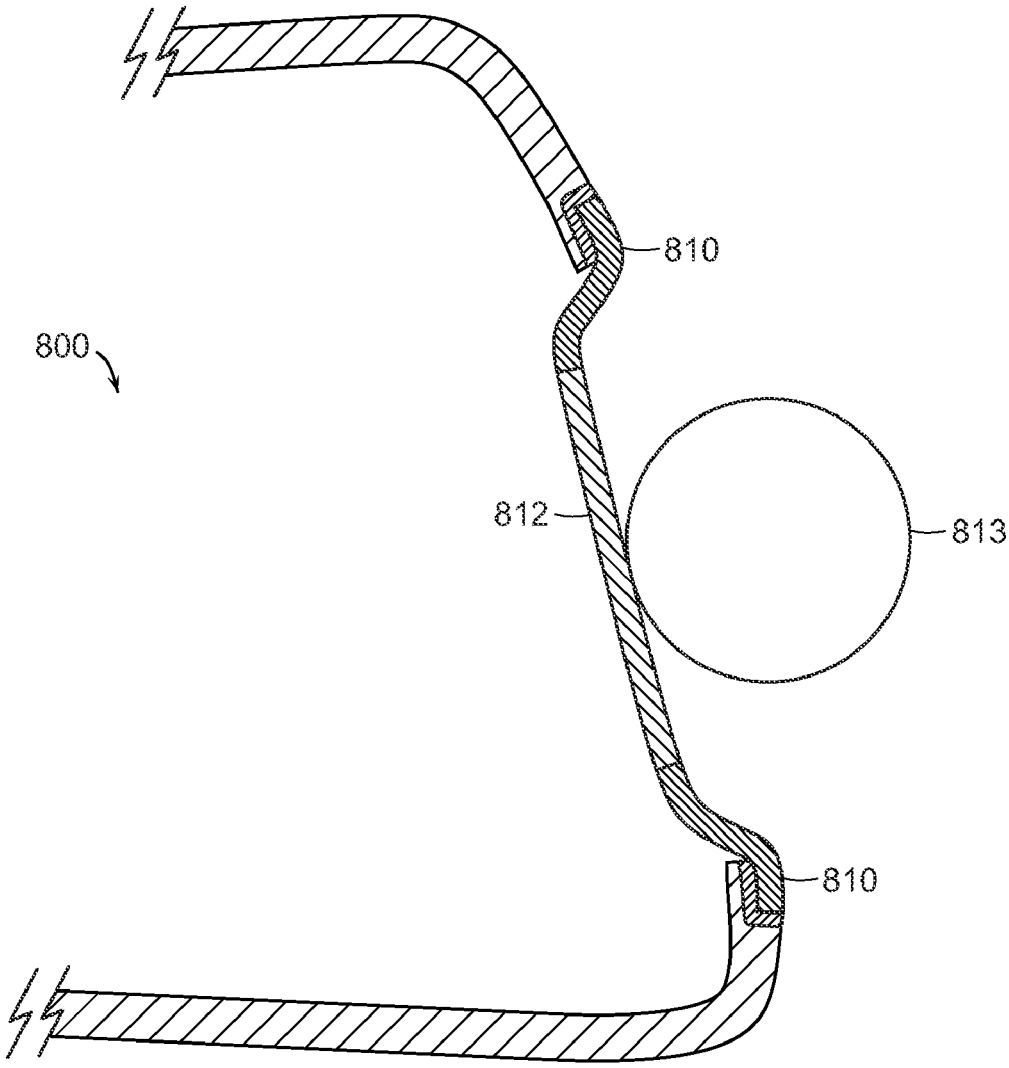
FIG. 8 shows an enlarged cross-sectional view of a golf club head shown in FIG. 6 impacting a golf ball.

The effect of having the perimeter portion 710 and the central portion 712 having a different modulus of elasticity may be illustrated in FIG. 8 showing the reaction of the replaceable striking face 802 as it impacts a golf ball 813. Within this current exemplary embodiment, the perimeter portion 810, having a lower modulus of elasticity, will generally flex more than the central portion 812 having a higher modulus of elasticity, upon impact with a golf ball. As it can be seen from FIG. 8, because the perimeter portion 810 is more flexible than the central portion 812, the perimeter portion 810 will flex more upon impact with a golf ball 813, while the central portion 812 will remain relatively rigid creating a larger sweet spot that trampolines in and out of the golf club head 800.

Figure 9:
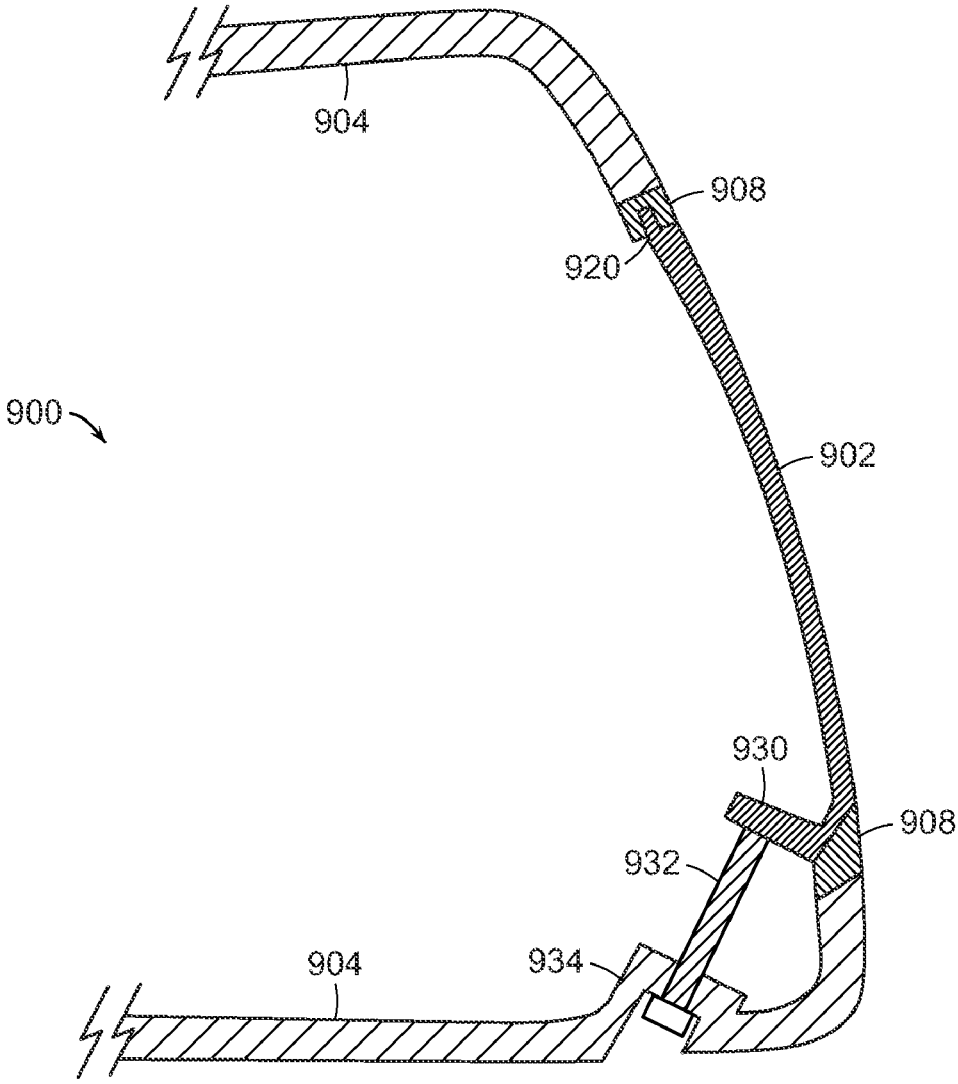
FIG. 9 shows a cross-sectional view of a golf club head in accordance with an alternative embodiment of the present invention taken along cross-sectional line B-B' shown in FIG. 1*a;*

FIG. 9 shows a cross-sectional view of a further alternative embodiments of the present invention taken along cross-sectional line B-B' as shown in FIG. 1*a*; wherein a different attachment mechanisms may be used to removably attach the replaceable striking face 902 to the golf club head 900. Golf club head 900, shown here in this current exemplary embodiment in FIG. 9, may utilize a combination of connection tabs 920 and screws 932 to connect the replaceable striking face 902 to the body 904. More specifically, the replaceable striking face 902 utilizes one or more connection tabs 920 near the crown portion of the golf club head 900 to connect to the crown portion of the body 904. The one or more connection tabs 920 on the replaceable striking face 902 may generally be inserted into a slot within the body 904 to complete the connection mechanism near the crown portion of the replaceable striking face 902. In addition to the crown portion connection, the sole portion utilizes a plurality of one or more screws 932 to connect the striking face 902 to the body 904 after the crown portion of the replaceable striking face is properly snapped into its proper position within the body 904. More specifically, the plurality of one or more screws 932 in this embodiment pass through a plurality of one or more corresponding screw wells 934 on the sole portion of the body 904 to connect to a bent bottom portion 930 of the replaceable striking face 902. The bent bottom portion 930 of the replaceable striking face 902 may generally be bent rearwards and upwards at the sole portion of the golf club head 900 to create terminal end to engage the plurality of screws 932, which removably secures the replaceable striking face 902 to the body 904 of the golf club head 900. It is worth noting in FIG. 9 the bent bottom portion 930 is angled in a way that prevents the replaceable striking face 902 from sliding outward. This angled connection works in conjunction with the compression forces coming from the plurality of screws 932 to push the replaceable striking face 902 into the desired position. Finally, it should be noted that the golf club head 900 may also incorporate a vibration dampening material 908 in between the replaceable striking face 902 and the body 904 to ensure a secure and proper fit between the two components and eliminate any vibration between the two components as well as provide an effective seal to the golf club head 900.

Figure 10:
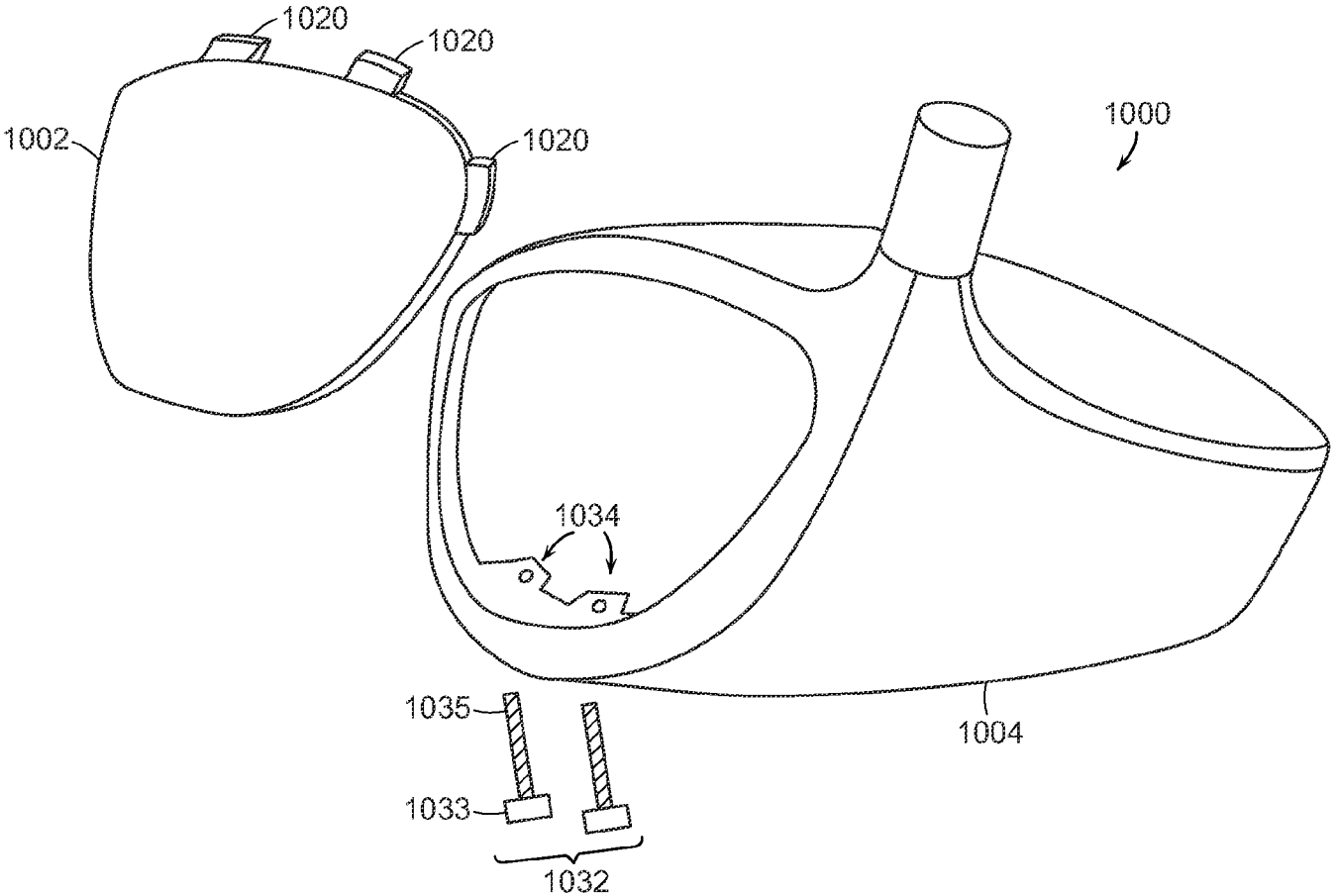
FIG. 10 shows an isometric perspective view of a golf club head in accordance with an exemplary embodiment of the present invention.

FIG. 10 shows a perspective view of the golf club head 1000 with the replaceable striking face 1002 detached to further illustrate the connection mechanism between the replaceable striking face 1002 and the body 1004. With the replaceable striking face 1002 detached, FIG. 10 more clearly shows the screw wells 1034 near the sole portion of the body 1004 as well as the plurality of one or more screws 1032 used to attach the components together. The perspective view of golf club head 1000 shown in FIG. 10 also allows for a better visualization of the plurality of one or more connection tabs that will generally be snapped into crown portion of the body 1004 before the replaceable striking face 1002 engages the plurality of screws 1032 via the corresponding screw wells.

In addition to the above, FIG. 10 shows the plurality of screws 1032 being detached from the golf club head 1000. With the plurality of screws 1032 detached, it is easier to show a proximal end 1033 and a terminal end 1035 of the plurality of screws 1032. More specifically, the proximal end 1033 of the plurality of screws 1032 may generally include the head of a screw, and engage the plurality of screw wells 1034 near the sole portion of the golf club head 1000. The terminal end 1035 of the plurality of screws 1032 may generally include the threaded end of the screw, and engages the plurality of bent bottom portion 930 (shown in FIG. 9) or any similar receptacle of the replaceable striking face 1002 all without departing from the scope and content of the present invention.

Figure 11:
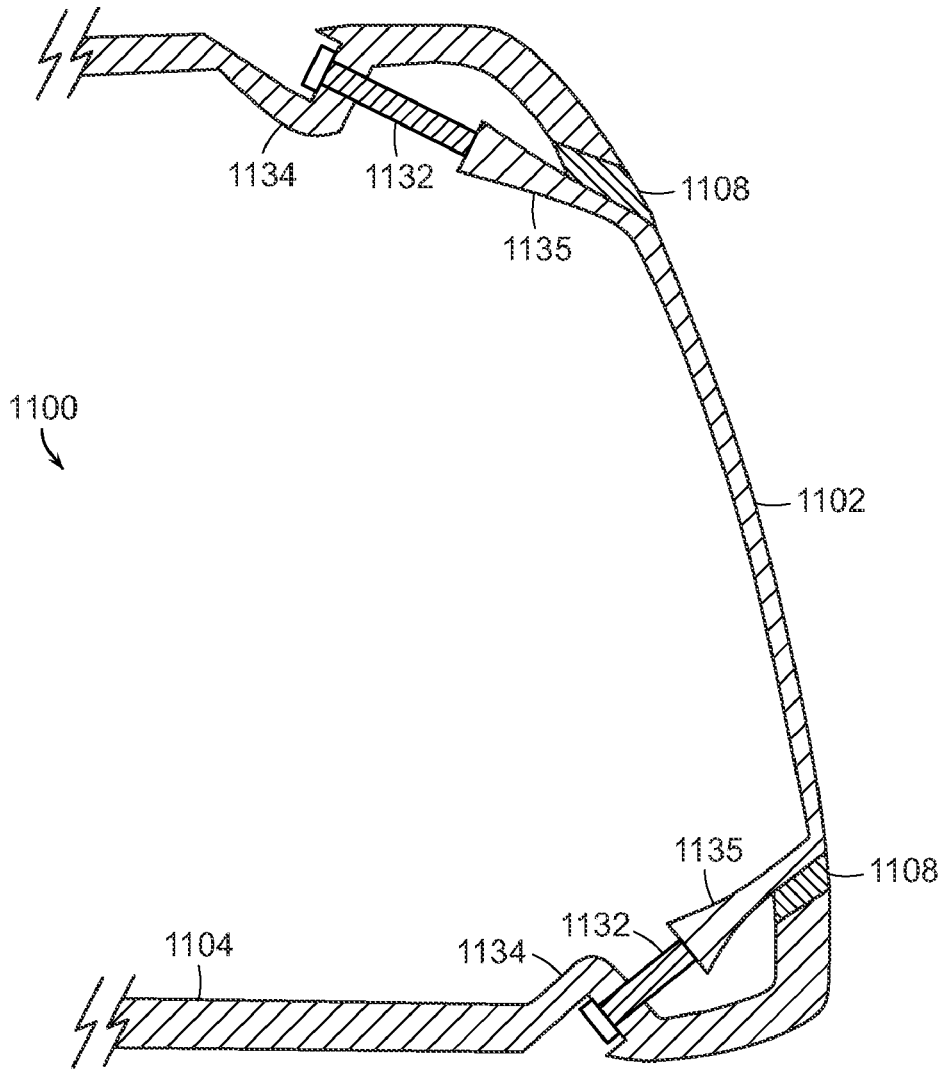
FIG. 11 shows a cross-sectional view of a golf club head in accordance with a further alternative embodiment of the present invention taken along cross-sectional line B-B' shown in FIG. 1*a;*

FIG. 11 shows a cross-sectional view of a further alternative embodiment of the present invention taken along cross-sectional line B-B' as shown in FIG. 1*a*; wherein the golf club head 1100 utilizes a multiple screw system to removably attach the replaceable striking face 1102 to the body 1104 of the golf club head 1100. In this alternative embodiment shown in FIG. 11, the golf club head 1100 utilizes a plurality of screws 1132 in combination with a plurality of screw wells 1134 at both the crown portion and the sole portion of the golf club head 1100 to removably attach the replaceable striking face 1102. It should be noted that in this current exemplary embodiment, the golf club head 1100 may utilize a plurality of screw receptacles 1135 instead of the bent bottom portion to offer an alternative way to connect the replaceable striking face 1102 without departing from the scope and content of the present invention. Utilizing a plurality of screws 1132 at both the crown portion and the sole portion creates a more secure fit between the replaceable striking face 1102 and the body 1104. It should be noted that in this current exemplary embodiment, the connection between the replaceable striking face 1102 and the body 1104 is angled in a way that prevents the replaceable striking face 1102 from sliding outward. This angled connection works in conjunction with the compression forces coming from the plurality of screws 1132 to push the replaceable striking face 1102 into the desired position. Finally, it should be noted that the golf club head 1100 may also incorporate a vibration dampening material 1108 in between the replaceable striking face 1102 and the body 1104 to ensure a secure and proper fit between the two components and eliminate any vibration between the two components.

Figure 12:
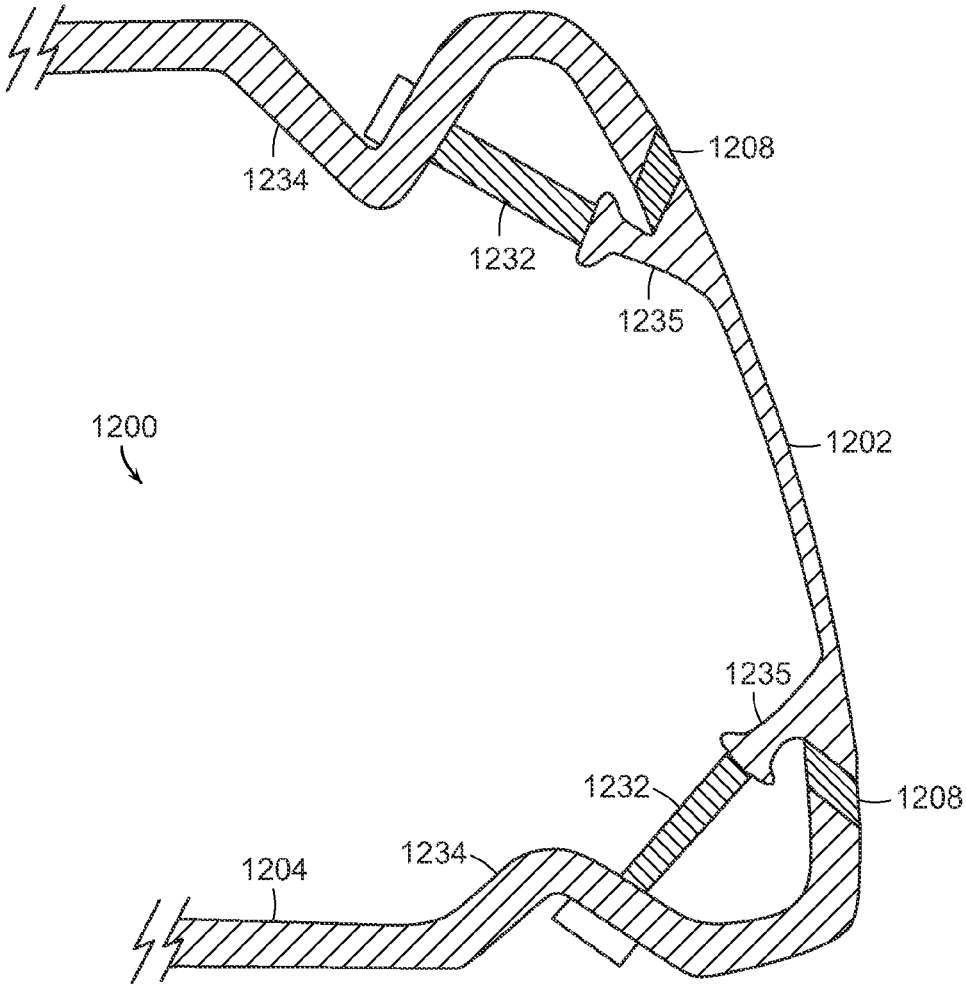
FIG. 12 shows a cross-sectional view of a golf club head in accordance with a further alternative embodiment of the present invention taken along cross-sectional line B-B' shown in FIG. 1*a;*

FIG. 12 shows a cross-sectional view of a further alternative embodiment of the present invention taken along cross-sectional line B-B' as shown in FIG. 1*a*; wherein the golf club head 1200 utilizes multiple screw system to removably attached the replaceable striking face 1202 to the body 1204 of the golf club head. The golf club head 1200 shown in the current embodiment utilizes the plurality of screws 1232 to pull the replaceable striking face 1202 into the desired position instead of pushing as shown in FIG. 11. It is also worth noting that FIG. 12 also shows an alternative way to position the plurality of screw wells 1234 within an angled cavity to ergonomically connect the plurality of screws 1232 to their respective screw receptacles 1235. The screw wells 1234 shown here may generally have an extra bend section to promote the ergonomic connection between the components instead of a flat screw well 1234 shown in FIG. 11. It is worth nothing that FIG. 12 shows the plurality of screws 1232 pulling the replaceable striking face 1202 against the angled connected between the replaceable striking face 1202 and the body 1204. This pulled connection mechanism may be desirable in this current exemplary embodiment because it aligns the direction of the connection forces with the impact forces of a golf ball. Thus, under this embodiment shown here in FIG. 12, impact forces from a golf ball may actually help secure the connection between the replaceable striking face 1202 and the body 1204 portion of the golf club head 1200. Finally, it should be noted that the golf club head 1200 may also incorporate a vibration dampening material 1208 in between the replaceable striking face 1202 and the body 1204 to ensure a secure and proper fit between the two components and eliminate any vibration between the two components.

Figure 13:
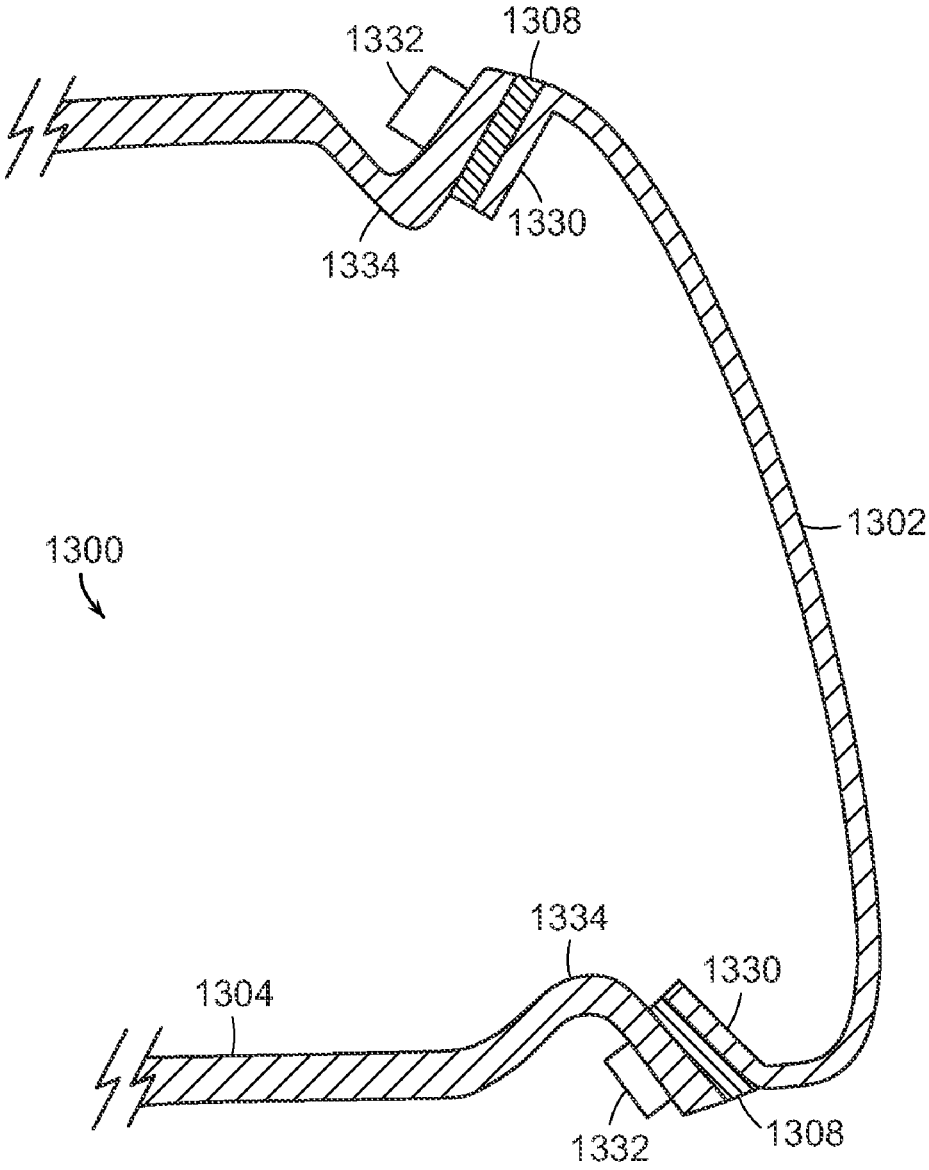
FIG. 13 shows a cross-sectional view of a golf club head in accordance with a further alternative embodiment of the present invention taken along cross-sectional line B-B' shown in FIG. 1*a;*

FIG. 13 shows a cross-sectional view of an even further alternative embodiment of the present invention taken along cross-sectional line B-B' as shown in FIG. 1*a*; wherein the golf club head 1300 utilizes an enlarged replaceable striking face 1302 that covers the entire frontal striking surface. This alternative embodiment of the present invention shown in FIG. 13 shifts the bent portions 1330 of the replaceable striking face 1302 further away from the impact area of the replaceable striking face 1302 to help alleviate the stresses that could arise during impact with a golf ball. Golf club head 1300, by having the connection mechanism shifted toward the blend areas of the golf club head, may also provide additional trampoline effect because the plurality of screw wells 1334 could absorb some of the impact and deform elastically to provide additional trampoline effect in addition to the ones offered by the thinned face. Similar to all other embodiments golf club head 1300 may incorporate a vibration dampening material 1308 sandwiched between the replaceable striking face 1302 and the body 1304.

Figure 14:
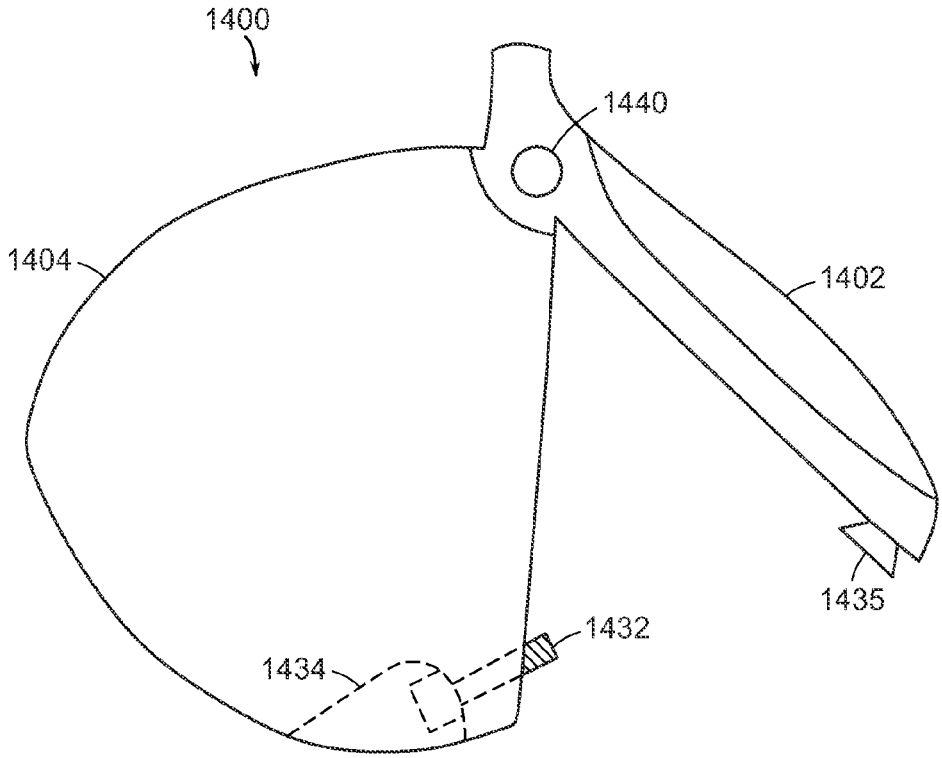
FIG. 14 shows a top view of a golf club head in accordance with a further alternative embodiment of the present invention.

FIG. 14 shows a top view of a golf club head 1400 in accordance with a further alternative embodiment of the present invention wherein the replaceable striking face 1402 swivels around the shaft axis 1440 to provide another method to connect the replaceable striking face 1402 to the body 1404 of the golf club head 1400. The swiveling feature of golf club head 1400, in accordance with this further alternative embodiment of the present invention, may provide an additional advantage in that it could incorporate an already existing hosel screw connection mechanism at the shaft axis 1440 of the golf club head 1400 to provide a simplified way to make the replaceable striking face 1402 easily removable and replaceable. Golf club head 1400 may generally utilize at least one screw well 1434 near the toe end of the body 1404 of the golf club head 1400 to provide a securing mechanism between the replaceable striking face 1402 and the body 1404 portion of the golf club head. More specifically, the plurality of screw well 1434 may generally receive a screw 1432 that extrudes from the body 1404 into a screw receptacle 1435 on the back of the replaceable striking face 1402 to complete the connection.

Figure 15:
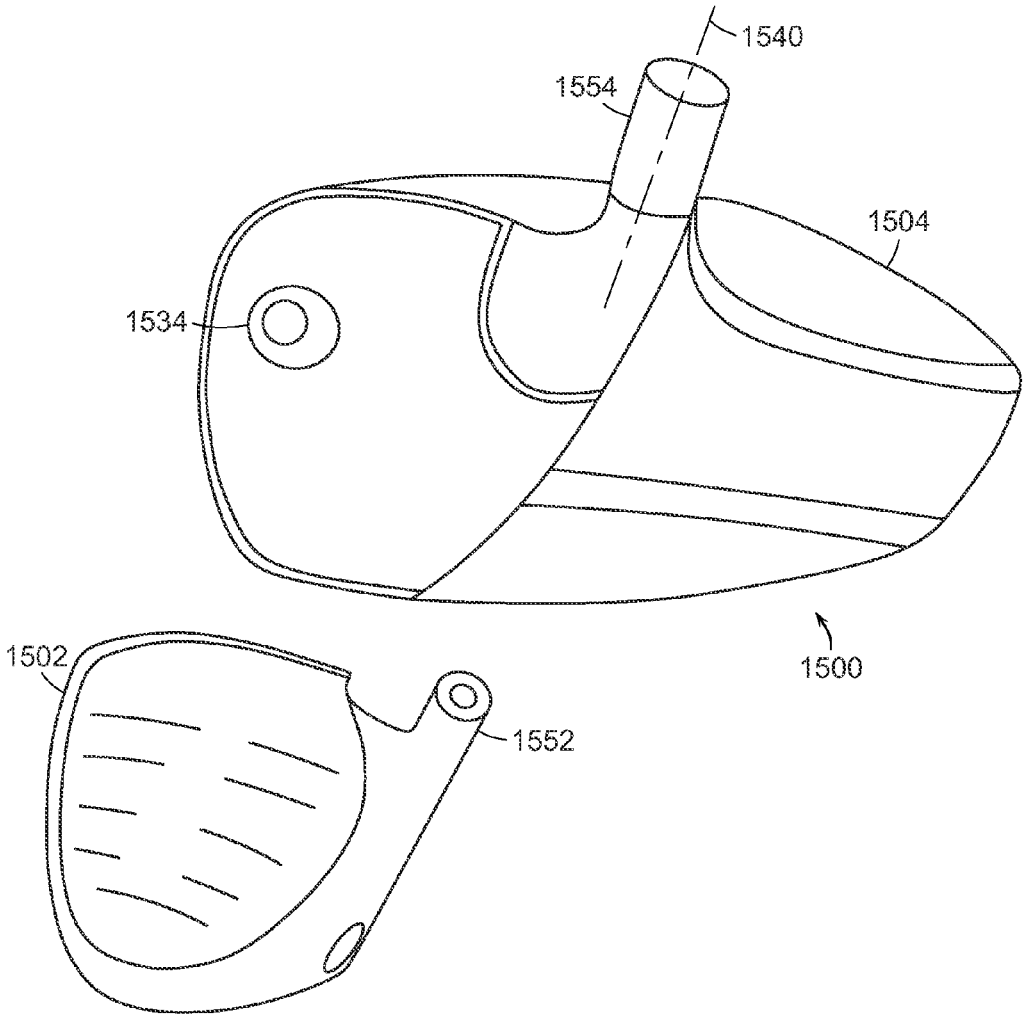
FIG. 15 shows an isometric perspective view of a golf club head in accordance with a further alternative embodiment of the present invention.

FIG. 15 shows an isometric exploded view of a golf club head 1500 utilizing the swiveling replaceable striking face 1502. This isometric exploded view of the golf club head 1500 illustrates how the replaceable striking face 1502 may be connected to the body 1504 portion of the golf club head. In order to assemble the swiveling replaceable striking face 1502, the internal hosel portion 1552 located on the replaceable striking face 1502 is inserted into the external hosel portion 1554 located on the body 1504 while keeping the replaceable striking face 1502 in an open position. Once the internal hosel portion 1552 is properly assembled within the external hosel portion 1554 along the shaft axis 1540, the entire replaceable striking face 1504 may swivel about the shaft axis 1540 from an open position to a closed position at which point the screw well 1534 may engage the screw receptacle (shown in FIG. 14) to secure the replaceable striking face 1502 to the body 1504 of the golf club head 1500.

Figure 16:
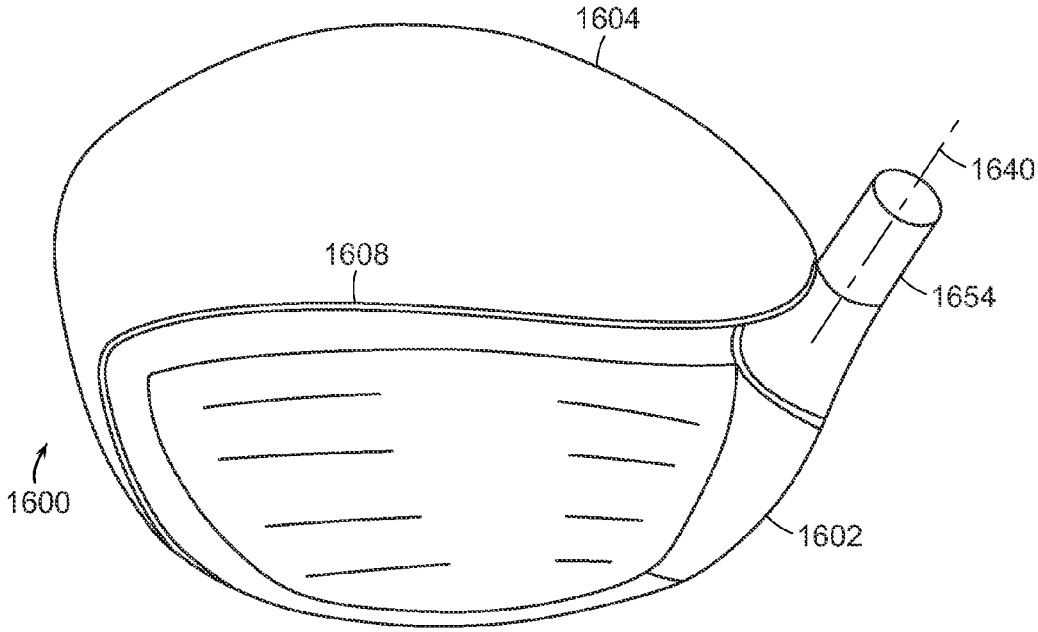
FIG. 16 shows an elevated front view of a golf club head in accordance with a further alternative embodiment of the present invention.

FIG. 16 shows a front elevated view of a golf club head 1600 in accordance with the alternative embodiment of the present invention involving a swiveling replaceable striking face 1602. It should be noted that this front elevated view allows the vibration dampening material 1608 between the replaceable striking face 1602 and the body 1604 of the golf club head 1600 to be more visible. Similar to other vibration dampening materials discussed earlier, the vibration dampening material 1608 used in this swiveling replaceable striking face 1602 will help absorb the vibrations that could result from the impact when the golf club head 1600 hits a golf ball.

Figure 17:
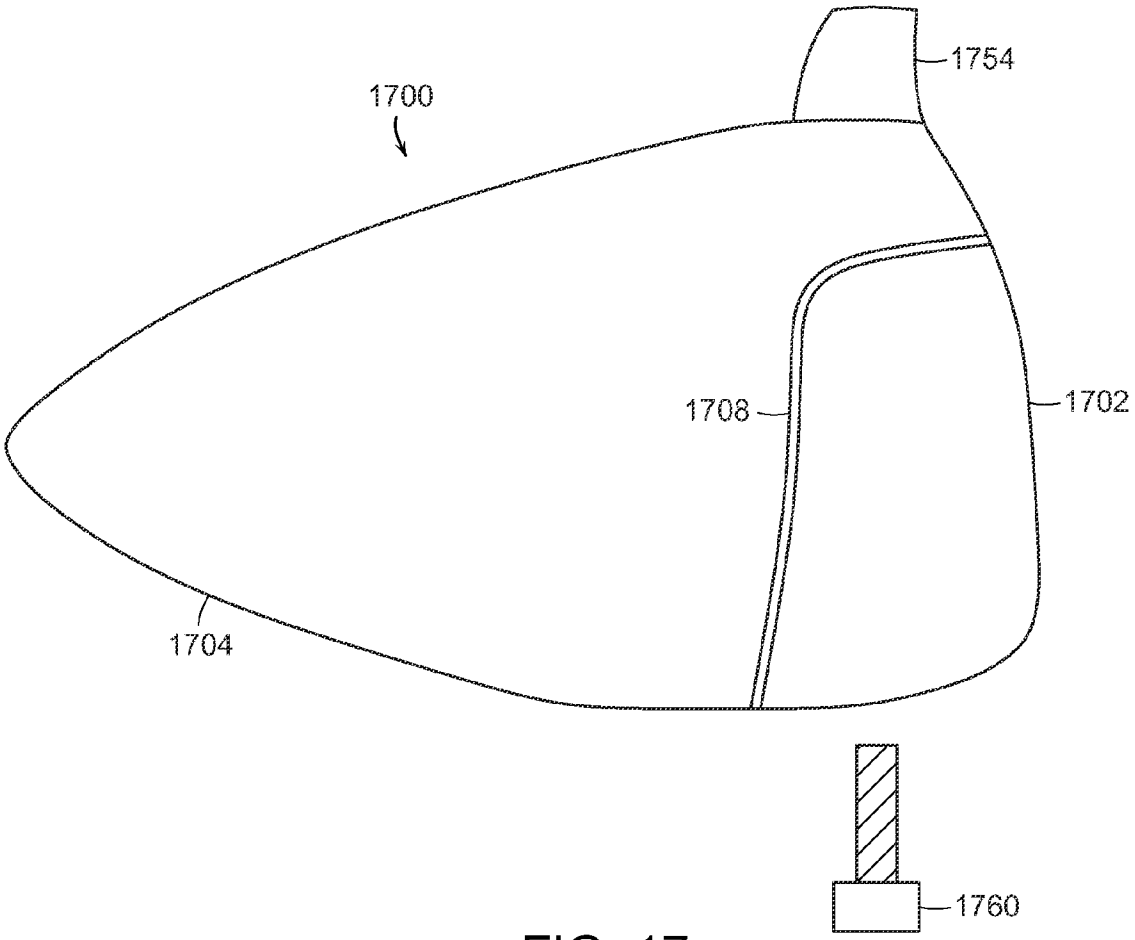
FIG. 17 shows a side view of a golf club head in accordance with a further alternative embodiment of the present invention.
Figure 18:
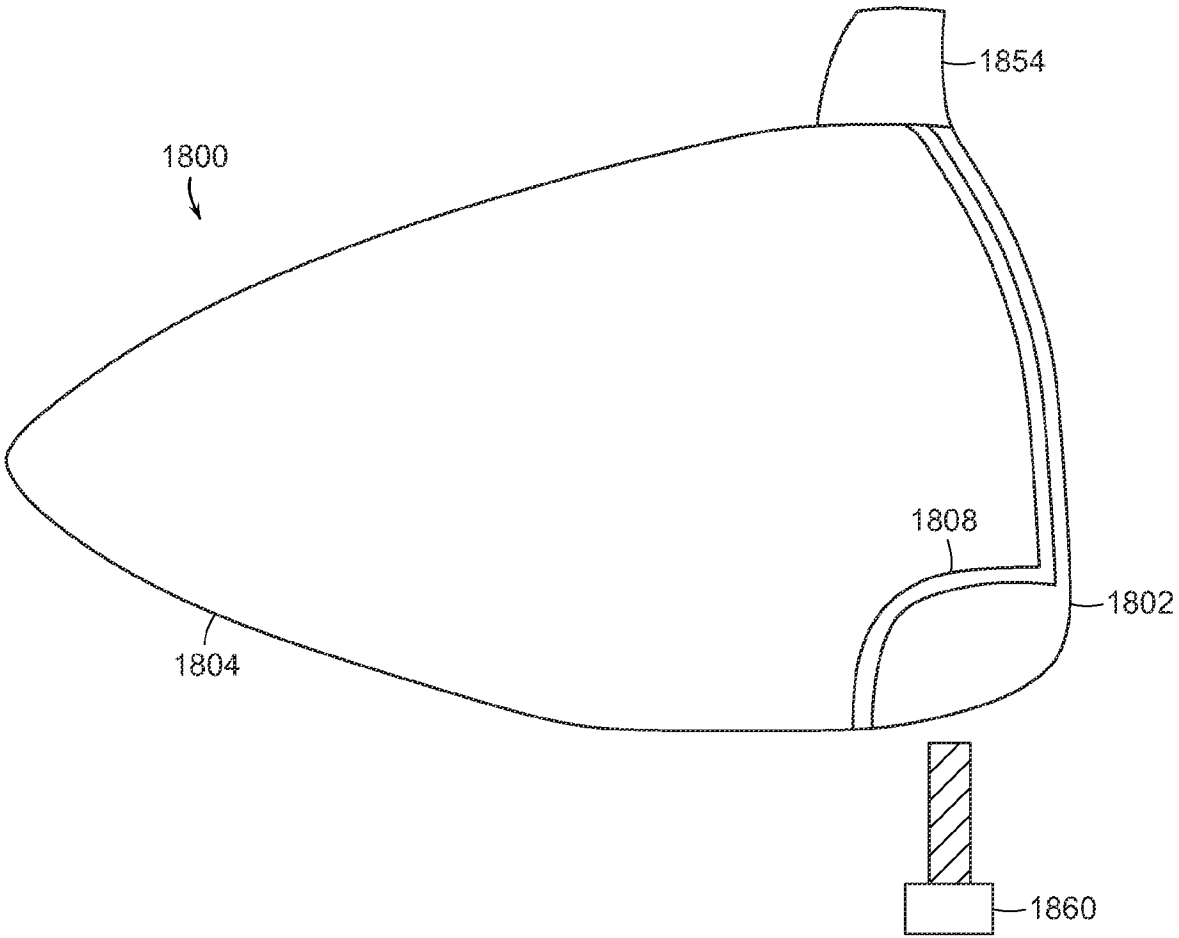
FIG. 18 shows a side view of a golf club head in accordance with a further alternative embodiment of the present invention.

FIGS. 17 and 18 show two further alternative embodiments of the present invention utilizing a swiveling replaceable striking face 1702 and 1802 respectively. FIGS. 17 and 18, by showing side views of the golf club heads 1700 and 1800 from the heel direction, show different sizes and shapes of the replaceable striking faces 1702 and 1802 that may be used to achieve different coupling profiles. Replaceable striking face 1702, as shown in this exemplary embodiment in FIG. 17, may have a taller toe portion to allow for more of the replaceable striking face 1702 to wrap around the body 1704. Having more of the replaceable striking face 1702 wrapping around the body 1704 may be desirable as such a configuration allows a more secure connection between the two components. Replaceable striking face 1802 shown in FIG. 18, on the other hand, may have a shorter toe portion to allow for less of the replaceable striking face 1802 to wrap around the body 1804. Having less of the replaceable striking face 1802 wrapping around the body 1804 may be desirable as such a configuration will allow more of the face to engage and flex upon impact with a golf ball. Similar to above, both golf club head 1700 and golf club head 1800 could incorporate a vibration dampening material 1708 and 1808 respectively to help absorb the vibration that could occur between the replaceable striking face 1702 and 1802 together with the body 1704 and 1804. Vibration dampening material 1708 and 1808 could also help ensure proper connection between the components and prevent gaps between the separate components.

It should be noted that once a golf club head is removed from the constraint of having the striking face being permanently attached to the body of the golf club head, numerous other design advantages could arise other than those advantages mentioned above. For example, as it will be apparent upon further examination of the above referenced figures, a golf club head in accordance with the present invention utilizing a replaceable striking face could potentially have different lofts. More specifically, it can be seen from the current disclosure that because the striking face is removable and replaceable, the replaceable striking face need not have the same loft as the original replaceable striking face that was removed. Hence, a golf club head in accordance with the present invention may offer an additional benefit of customizing various other features of the striking face in addition to the performance benefits discussed above without departing from the scope and content of the present invention.

In addition to ensure proper connection between the components and preventing gaps, the vibration dampening material discussed above may also help with the acoustic sound properties of a golf club head. Modern day golf club heads, in an attempt to increase in size while removing weight from undesirable places, have yielded very thin walls made out of various materials such as titanium and composite materials. These thin areas of the golf club head tend to vibrate at different natural frequencies compared to thick areas, creating a change in the sound output of the golf club head. Extreme vibration within a golf club head upon impact may generally be undesirable, as these extreme vibrations may adversely affect the acoustic sound properties of a golf club head.

Figure 19:
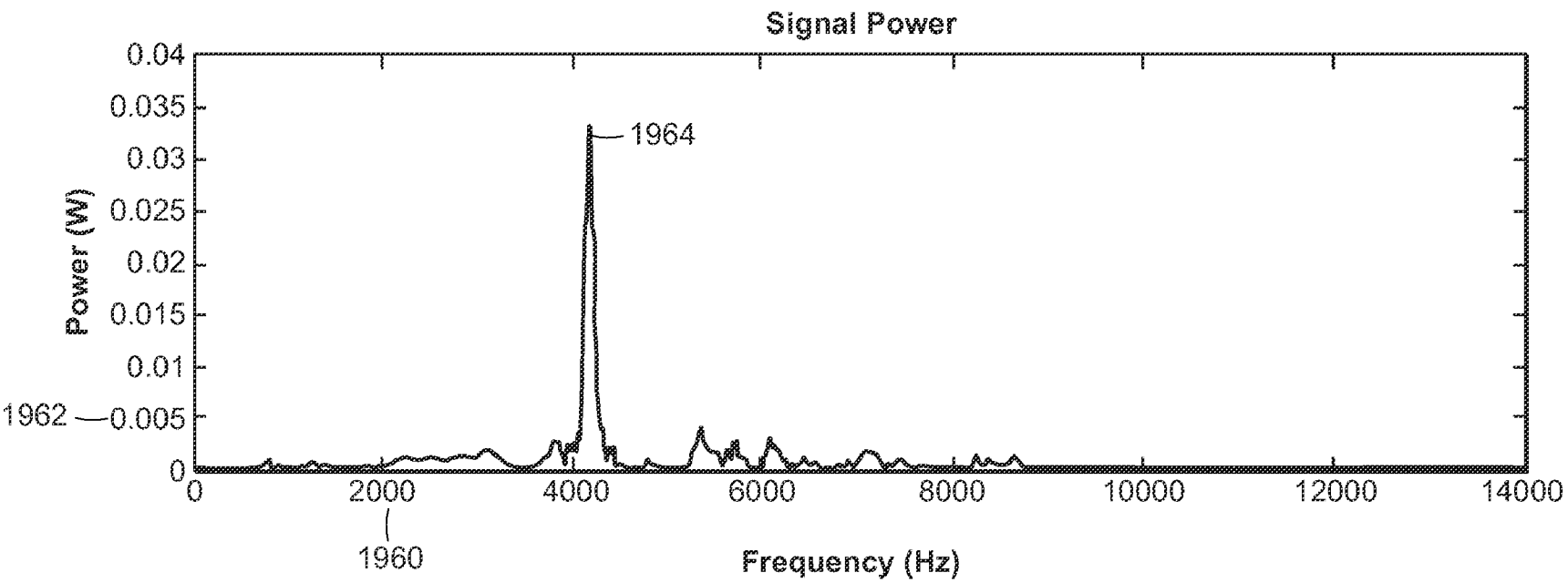
FIG. 19 shows graphical representation of the sound of a golf club head's signal power in accordance with an exemplary embodiment of the present invention.

Because the current invention may tend to utilize a thinned replaceable striking face, acoustic vibration tends to be more of a concern in a golf club head in accordance with the present invention than it would be in a traditional type golf club head. FIG. 19 shows the signal power diagram of a golf club head in accordance with an exemplary embodiment of the present invention to better help illustrate the sound and acoustic vibration of a golf club head. More specifically, FIG. 19 captures the power 1962 of the sound generated by a golf club head as it impacts a golf ball as a function of the frequency 1960 due generally to the vibration of the sole in combination with the replaceable striking face. As we can see from FIG. 19, the current inventive golf club head produces a first peak in sound power 1962 at approximately 4,000 hertz. This entire signal power diagram shown in FIG. 19 may generally represent a graphical representation of the sound of a golf club as it comes into contact with a golf ball; and the first sound peak of the sound power 1962 at 4,000 hertz may generally be known as the first mode frequency 1964. In order to create a desirable sound that is achieved by the proper attenuation of the vibration within a golf club head, the first mode frequency 1964, or the first peak of power 1962, may generally be greater than about 3,000 hertz, more preferably greater than about 3,250 hertz, and most preferably greater than about 3,500 hertz.

Figure 20:
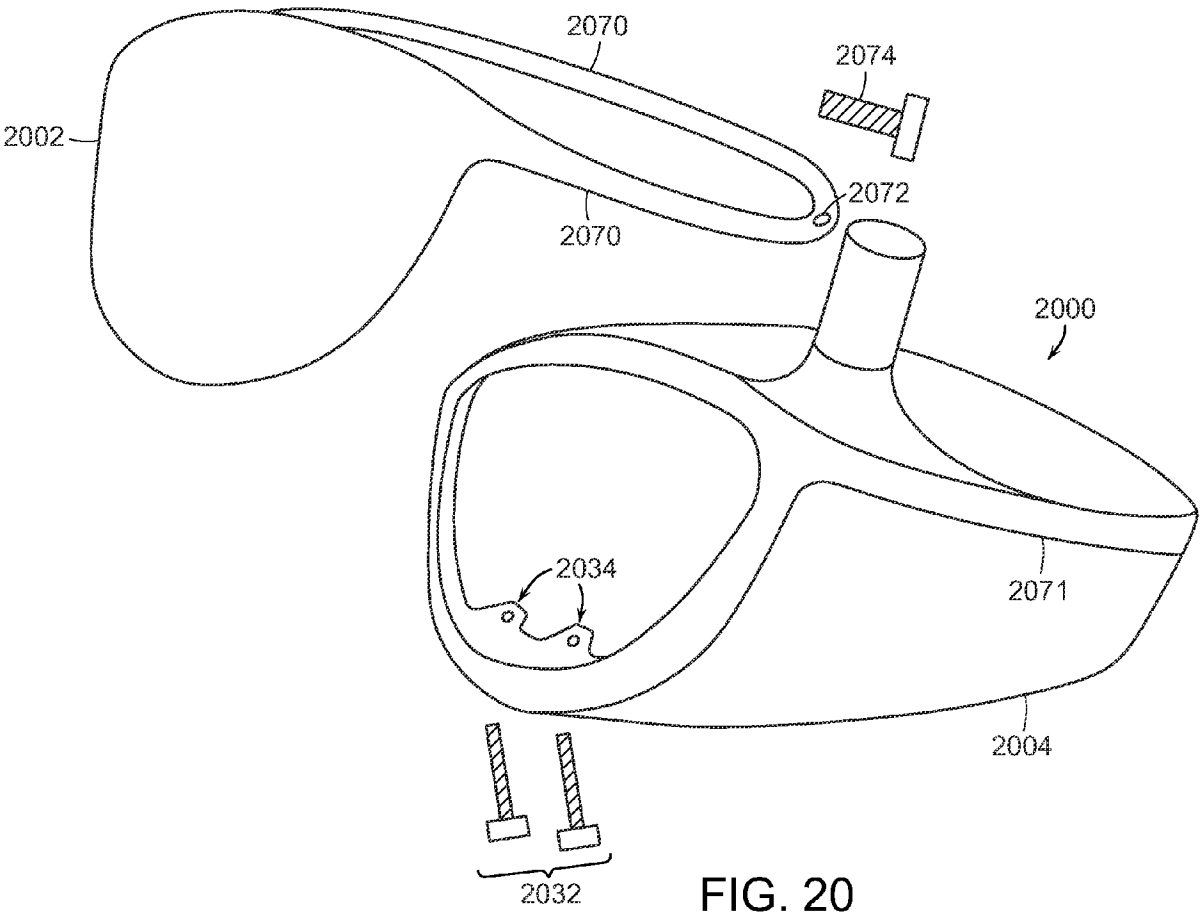
FIG. 20 shows an isometric perspective view of a golf club head in accordance with a further alternative embodiment of the present invention.

Turning now to FIG. 20 showing a further alternative embodiment of the present invention wherein the replaceable striking face 2002 may include an attachment band 2070 that encircles the skirt 2071 portion of the body 2004 of the golf club head 2000. This alternative attachment mechanism shown in FIG. 20 may generally allow a screw 2074 to be used near the rear portion of the golf club head 2000 to connect the replaceable striking face 2002 to the body 2004 of the golf club head 2000. Under this alternative embodiment, the attachment band 2070 may generally detach from each other at the terminal end in order to securely encompass the skirt 2071 portion of the golf club head 2000, while overlapping at the screw receptacle 2072 portion of the attachment band 2070. Once the attachment band 2070 is securely placed within the mating portion of the skirt 2071, the screw 2074 may be inserted into the screw receptacle 2072 portion of attachment band 2070 as well as a screw well (not shown) within the body to tighten the attachment band 2070 and securely connect the replaceable striking face 2002. It should be noted that in this embodiment, the tightness of the screw 2074 correlates with the tightness of the attachment of the replaceable striking face 2002; hence the tighter the screw 2074, the tighter the replaceable striking face 2002. FIG. 20 also shows a plurality of one or more screws 2032 near the sole portion of the golf club head 2000 to secure the bottom portion of the replaceable striking face 2002 to the body 2004 of the golf club head 2000.

Figure 21:
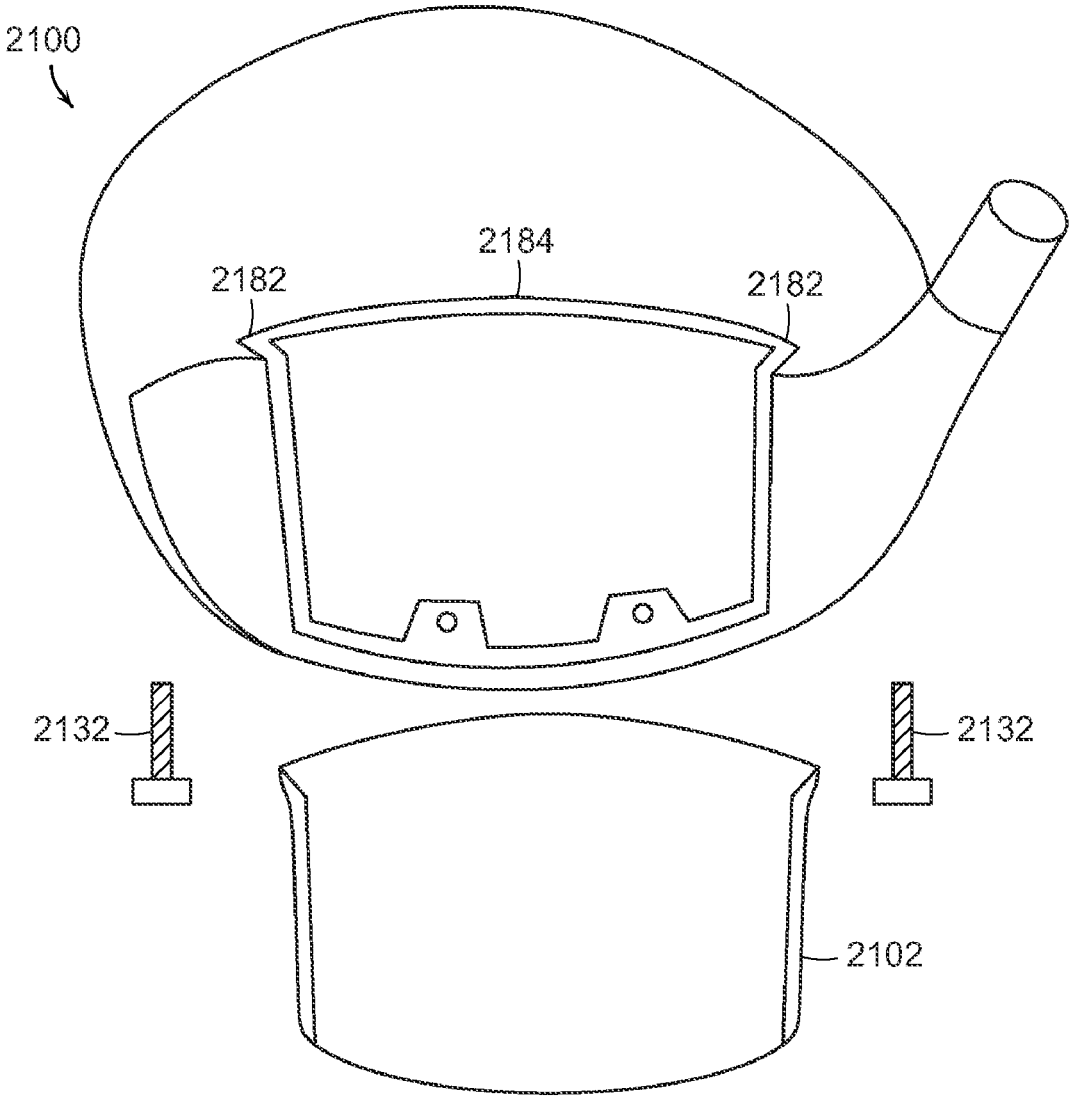
FIG. 21 shows a top view of a golf club head in accordance with a further alternative embodiment of the present invention.

FIG. 21, on the other hand, shows a further alternative embodiment of the present invention wherein the replaceable striking face 2102 may be slidably attached to the golf club head 2100. More specifically, the golf club head 2100 shown in FIG. 21, shows a plurality of dovetail guides 2182 allowing a replaceable striking face 2102 to slide into its appropriate slot within the golf club head 2100 to provide an alternative connection mechanism. It should be noted that in this alternative embodiment, the golf club head 2100 may contain a stopper at the crown portion 2184 of the golf club head to ensure proper connection near the top of the golf club head 2100. In addition to the stopper, the golf club head 2100 may also utilize a plurality of one or more screws 2132 to work in connection with a plurality of screw wells 2134 near the sole portion of the golf club head to complete the connection mechanism. It should be noted that although the current figure FIG. 21 does not show a vibration dampening layer sandwiched between the replaceable striking face 2102 and the golf club head 2100, a vibration dampening layer could be used in between the replaceable striking face 2102 and the golf club head 2100 without departing from the scope and content of the present invention. Furthermore, although the current golf club head 2100 shows the plurality of dovetail guides 2182 placed vertically along the striking face portion of the golf club head, the plurality of dovetail guides 2182 may also run horizontally along the striking face portion of the golf club head without departing from the scope and content of the present invention.

Figure 22:
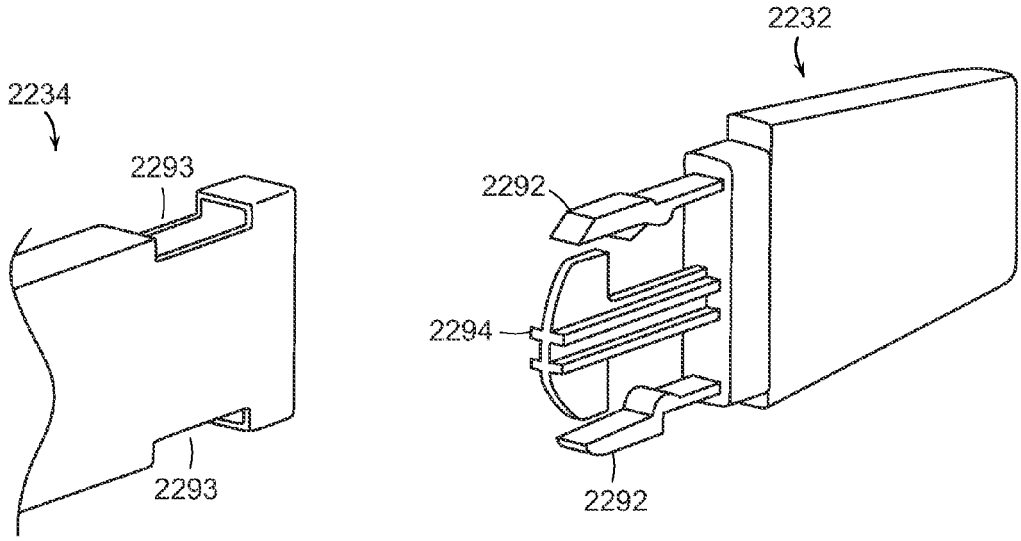
FIG. 22 shows a perspective view of an alternative attachment mechanism in accordance with an alternative embodiment of the present invention.

Finally, it should be recognized that although most of the connection mechanism shown in this disclosure utilizes a plurality of one or more screws to secure the replaceable striking face to the body of the golf club head, various other connection mechanism may be used without departing from the scope and content of the present invention; so long as it provides a suitable connection between the above mentioned components. More specifically FIG. 22 shows an alternative connection mechanism comprising of a male connection portion 2232 and a female connection portion 2234 that can be used in lieu of a screw. Even more specifically, the alternative connection mechanism shown in FIG. 22 may comprise of a side-release buckle mechanism with a plurality of resilient arms 2292 mixed in with a rigid arm 2294 on the male connection portion 2232 to interface with a plurality of slots 2293 within a cavity of the female connection portion 2232. This alternative connection mechanism offers a distinct advantage over screws in that it is simple to connect and disconnect, and does not require any additional removal tools.

In order to securely connect the male connection portion 2232 to the female connection portion 2234 of this alternative embodiment, the rigid arms 2294 as well as the resilient arms 2292 protruding from the male connection portion may be pushed into the cavity of the female connection portion. Once the resilient arms 2292 reach a certain depth within the cavity of the female connection portion 2234, the resilient arms will snap into place within the plurality of corresponding slots 2293 within the female connection portion 2232. In order to remove the male connection portion 2232 from the female connection portion 2234, the resilient arms 2292 that's engaged with the plurality of corresponding slots 2293 may need to depressed and disengaged from the slots 2292. Once the resilient aims 2292 locking the components together is disengaged, the male connection portion 2232 may slidably retreat out of its position within the female connection portion 2234 to complete the removal process. The specifics of such an alternative connection mechanism may be found in U.S. Pat. No. 4,150,464 to Tracy, the disclosure of which is incorporated by reference in its entirety.

It should be noted that although the various figures here show, in combination or individually, different connection mechanisms to connect the replaceable striking face to the body of the golf club head; the present invention could include any one of the connection mechanism or a combination of multiple connection mechanisms to ensure the connection between the replaceable striking face and the body of the golf club head all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the foregoing portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desirable properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body comprising a crown portion and a sole portion; and a replaceable striking face releasably connected to said body comprising an impact zone and a connection zone, wherein a thickness of said impact zone is less than about 3.0 mm;

wherein said replaceable striking face further comprises of a sweet spot located within said impact zone;

wherein said sweet spot is defined as an area of a frontal striking surface of said golf club head having a characteristic time that is at least 99% of a maximum characteristic time of between about 239 microseconds to about 257 microseconds;

wherein said sweet spot comprises greater than about 6% of said frontal striking surface; and wherein said golf club head has a volume of greater than about 350 cc, and wherein said replaceable striking face is rotatably connected to a shaft axis of said golf club head.

2. The golf club head of claim 1, wherein a vibration dampening material is juxtaposed between said replaceable striking face and said body.

3. The golf club head of claim 2, wherein said replaceable striking face is connected to said body using at least one screw.

4. The golf club head of claim 3, wherein said replaceable striking face further comprises at least one screw receptacle to engage a terminal end of said at least one screw.

5. The golf club head of claim 4, wherein said body comprises at least one screw well to engage a proximal end of said at least one screw.

6. The golf club head of claim 5, where said at least one screw pushes said connection zone of said replaceable striking face into an angled portion of said body to properly secure said replaceable striking face into said body.

7. The golf club head of claim 5, wherein said at least one screw pulls said connection zone of said replaceable striking face into an angled portion of said body to properly secure said replaceable striking face into said body.

8. The golf club head of claim 5, wherein said at least one screw well is located near said sole portion of said golf club.

9. The golf club head of claim 8, wherein said at least one screw well is also located near said crown portion of said golf club head.

10. The golf club head of claim 5, wherein said at least one screw well is located near a toe portion of said golf club head.

11. The golf club head of claim 5, wherein said golf club head has a primary first mode frequency of greater than about 3,500 Hertz.

12. A golf club head comprising:

a body comprising a crown portion, a sole portion, and at least one screw well; and a replaceable striking face releasably connected to said body comprising an impact zone, a connection zone, and at least one screw receptacle, wherein said replaceable striking face is connected to said body using at least one screw engaging said at least one screw well and said at least one screw receptacle;

wherein a thickness of said impact zone is less than about 3.0 mm; and wherein said golf club head has a volume of greater than about 350 cc, and wherein said replaceable striking face is rotatably connected to a shaft axis of said golf club head.

13. The golf club head of claim 12, wherein a vibration dampening material is juxtaposed between said replaceable striking face and said body.

14. The golf club head of claim 13, wherein said at least one screw pushes said connection zone of said replaceable striking face into an angled portion of said body portion to properly secure said replaceable striking face into said body.

15. The golf club head of claim 13, wherein said at least one screw pulls said connection zone of said replaceable striking face into an angled portion of said body portion to properly secure said replaceable striking face into said body.

16. The golf club head of claim 13, wherein said at least one screw well is located near a toe potion of said golf club head.

17. The golf club head of claim 13, wherein said golf club head has a primary first mode frequency of greater than about 3,500 Hertz.

18. A golf club head comprising:

a body comprising a crown portion, a sole portion, and at least one screw well; and a replaceable striking face releasably connected to said body comprising an impact zone, a connection zone, and at least one screw receptacle, wherein said replaceable striking face is connected to said body using at least one screw engaging said at least one screw well and said at least one screw receptacle;

wherein said replaceable striking face comprises of a sweet spot defined as an area of a frontal striking surface of said golf club head having a characteristic time that is 99% of a maximum characteristic time of between about 239 microseconds to about 257 microseconds;

wherein said sweet spot comprises greater than about 6% of said frontal striking surface; and wherein said golf club head has a primary first mode frequency of greater than about 3,500 Hertz, wherein said replaceable striking face is rotatably connected to a shaft axis of said golf club head.

19. The golf club head of claim 18, wherein said at least one screw well is located near a toe portion of said golf club head.

* * * * *